US007077689B2

(12) United States Patent
Hölzle et al.

(10) Patent No.: US 7,077,689 B2
(45) Date of Patent: Jul. 18, 2006

(54) PLUG CONNECTOR FOR PRINTED CIRCUITS

(75) Inventors: Dieter Hölzle, Deckenpfronn (DE); Hubert Willmann, Bräunlingen (DE); Wilfried Weber, Schopfloch (DE)

(73) Assignee: Dieter Holzle Technik-Projekte GmbH, Deckenpfronn (DE)

( * ) Notice: Subject to any disclaimer, the term of this patent is extended or adjusted under 35 U.S.C. 154(b) by 183 days.

(21) Appl. No.: 10/239,709

(22) PCT Filed: Mar. 15, 2001

(86) PCT No.: PCT/DE01/00969

§ 371 (c)(1),
(2), (4) Date: Sep. 22, 2003

(87) PCT Pub. No.: WO01/73896

PCT Pub. Date: Oct. 4, 2001

(65) Prior Publication Data

US 2005/0032407 A1 Feb. 10, 2005

(30) Foreign Application Priority Data

Mar. 25, 2000 (DE) ..... 100 15 044

(51) Int. Cl.
*H01R 12/24* (2006.01)

(52) U.S. Cl. ..... 439/494; 439/67

(58) Field of Classification Search ..... 439/45, 439/493, 499, 492, 495, 62, 496, 78, 494, 439/260, 67, 404, 405
See application file for complete search history.

(56) References Cited

U.S. PATENT DOCUMENTS 5,816,845 A * 10/1998 Chishima et al. ..... 439/495
6,089,904 A * 7/2000 Wu ..... 439/495

* cited by examiner

*Primary Examiner*—Gary F. Paumen
*Assistant Examiner*—Edwin A. Leon
(74) *Attorney, Agent, or Firm*—Browdy and Neimark, PLLC

(57) ABSTRACT

A plug connector for printed circuits comprises a plug (10), which supports the contact section (42) of the printed circuit (40) on one side and a retaining element (261, 262), by means of which the plug (10) may be pre-fixed, restrained in a pre-determined axial catch position in the port. On passing the axial catch position, the contact section (42) reaches the contact position with the contact spot of the port, by means of a vertical movement component, where the contact section is locked in a final position by means of a locking element.

25 Claims, 24 Drawing Sheets

$Dz = Dx \cdot \sin\alpha$

FIG. 9E
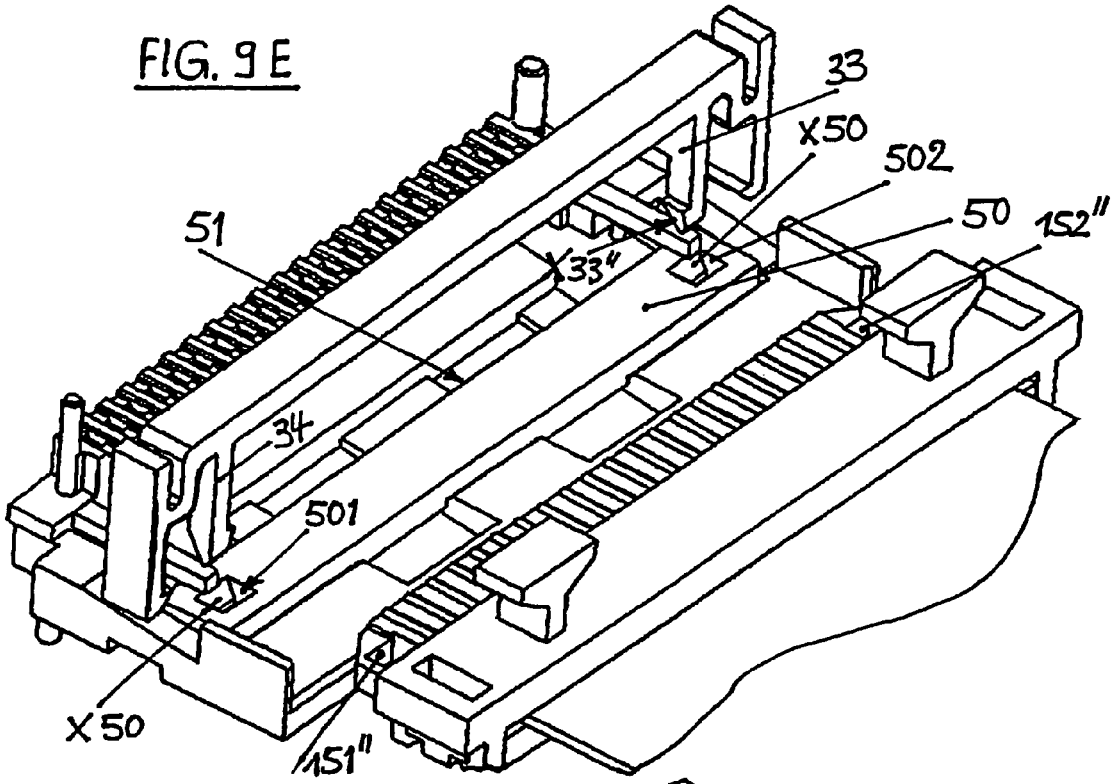
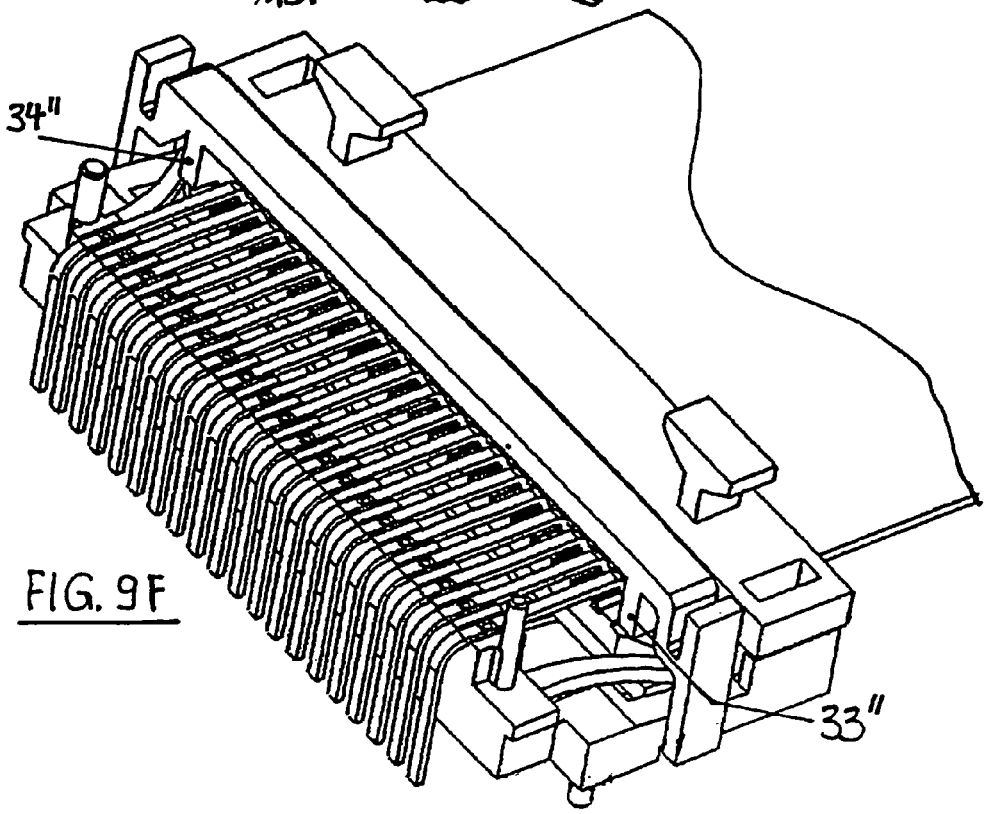
FIG. 9F

PLUG CONNECTOR FOR PRINTED CIRCUITS

The invention relates to a plug connector for ribbon cables with multiple conductors, having a plug, which at least partly surrounds the ribbon cable and leaves a contact portion free, and having a socket with contact points, into which the plug can be introduced as far as a predetermined contact position, in which the contact points of the socket and of the contact portion are in electrically conductive communication.

The socket here is embodied either as a counterpart plug or for purposes of assembly, for instance on a printed circuit, to which the ribbon cable is meant to be delivered.

One use of such plug connectors, for instance, is the electrical/electronic outfitting of motor vehicles, namely producing cable connections between the end users, such as a power lock system, power windows, adjustable outside mirrors, or speakers, on the one hand, and control units provided at another point in the motor vehicle on the other; increasingly for such connections, ribbon cables are being used, since they make a great number of conductors available.

As the first widely used standard version, plug connectors are known in which a flexible ribbon cable is inserted into the associated socket (housing), and the electrical connection is made as a result. It is also known in some cases to reinforce ribbon cables by applying a plastic film so that they do not kink as they are being plugged into the socket.

From U.S. Pat. No. 5,813,877, a plug connector is known which is designed in particular for connecting flexible conductor foils to contacts in a socket. To that end, the printed conductor film is enclosed by two halves of a plug, so that a front portion, by which the plug can then be introduced into the socket, protrudes. To enable the most perfect possible introduction of the flexible, printed conductor films, a spreading mechanism is provided, which includes a rib, followed by a transverse it on the upper part of the plug, by way of which the upper part of the socket slides in the insertion operation. This rib with the following transverse groove is dimensioned and positioned such that the introduction cross section for the printed conductor foil is widened, until the contacts provided there have reached the end contacts in the socket; after that, the rib springs elastically into a recess in the upper part of the socket and presses the end contacts against the associated contact tracks of the conductor foil.

It is a prerequisite of this version that the plug be introduced precisely into the socket, so as to put its opening and detent mechanism into play, which accordingly requires highly precise operator control, which in turn largely precludes automation, since even slight canting would already cause this construction to fail. The effectiveness and durability of the electrical contacting in this system depends decisively on the properties of the material of the socket, since the socket also dictates the spring properties of the tongue with which, once the contact end position is reached, the end contacts are pressed onto the conductor tracks of the printed conductor foil. It is well known that such plastic products are subject to relatively major variations in production, and they are temperature- and moisture-sensitive, and so the reliability of the contacts produced is only conditionally adequate.

German Patent Disclosure DE 198 18 677 A1 shows a two-piece electrical plug connector comprising a plug, provided with detent arms on its face end, and an associated socket for receiving these detent arms. The arms bring about locking of the plug and socket once the contact elements of the plug and socket have reached their contact position. The use of ribbon cables or printed conductor foils and the problems of making a connection using such structural elements is not addressed in this reference.

German Patent Disclosure DE 198 20 424 A1 shows an electrical plug connector which can be coupled by means of a separate slide. This requires equipping a line with a first connector part that has special coupling elements, embodied for instance as pegs, which can be introduced into the slide that is secured to a second connector part, and provision is made for a preassembled position of the slide on the second connector part. Not until the two connector parts are put together can a final locking be effected. It is not disclosed in this reference how the two connector parts are supposed to be connected with a line, of whatever kind, and in particular, there is no mention of ribbon cables or printed conductor foils.

A second version of the generic type in question is known from U.S. Pat. No. 4,808,113. From this reference, it is known for the ribbon cable to be provided with a plug (cable actuator), that makes a surface available on which the conductor portions of the ribbon cable are retained. This plug can then be inserted with this protrusion portion into the socket, whereupon an electrical connection between the conductor portions of the ribbon cable and corresponding conductor portions of the socket comes about. For fixing the plug and socket in the contact position intended as the final position, locking elements are provided between the socket and the plug. The version according to the present invention takes this prior art as its point of departure.

The version that is the subject of the aforementioned U.S. Pat. No. 4,808,113 dispenses with a plug for enclosing the ribbon cable, and instead prefers a drawerlike expansion of the socket, into which the end, insulated at least at the top, of a ribbon cable can be placed; when the drawer is pushed into a final position in the socket, the insulated tops of the ribbon cable are then acted upon by correspondingly arranged counterpart contacts on the inner top of the socket, and the electrical connection is made; in this version as well, the conductor ends, intended for making contact, of the ribbon cable are braced from below by the drawerlike component.

It is a common feature of both versions described above that the final mechanical detent position is identical to the electrical contact position. In the first standard version above, it is moreover necessary for the plug to be introduced with high precision into the suitably dimensioned insertion opening in the socket, which is complicated and virtually precludes fully automated production of a connection using manipulating devices such as industrial robots.

The version proposed in U.S. Pat. No. 4,808,113 does make it easier to introduce the insulated end of the ribbon cable into the slidelike drawer, provided there, of the socket, but for that purpose the ribbon cable itself must be grasped and moved without further aids, which requires a certain manual dexterity and cannot be accomplished with automatic devices, unless additional aids are employed.

SUMMARY OF THE INVENTION

The object of the invention is essentially to improve a plug connector in such a way that easier manual introduction of the ribbon cable into the socket is enabled, and in particular that the introduction can be performed partly or fully automatically with manipulating devices.

A fundamental concept of the invention is to divide the course of motion, upon insertion of the plug into the socket, into two segments:

A first segment in which the plug, provided with the ribbon cable, can be introduced up to a prelocking position, which requires no particularly precise orientation of the socket and plug with one another. Already in this prelocking position, a tension-relieved fixation of the ribbon cable in the socket is performed, which in the known versions is not achieved until simultaneously with the final detent locking or final fixation of the cable in the socket when the contact position is reached;

Only after that, in a second segment, by obtaining the prelocking, is the plug advanced onward into the final locking position, in which the electrical contacting is first effected and in which in a manner known per se, for instance by means of locking means, the plug and socket are connected to one another by nonpositive engagement.

The "shifting forward" of the mechanical coupling between the plug and the socket in conjunction with a plug and the prelocking makes it possible to design an introduction slit in the socket that is larger than the cross section of the plug, so that the accuracy of "hitting the target" on inserting the plug into the socket up to the prelocking position is very high, which is quite useful both if this operation is performed manually and if it is done with the aid of a manipulating device. It is thus also possible with process technology to perform an initially merely mechanical association of a plurality of ribbon cables with a plurality of sockets, for instance on the same or three-dimensionally remote circuit boards, and later to perform the final contact-making between the respective conductor portions of the ribbon cable and sockets, which can be of considerable advantage particularly where relatively extensive wiring systems and cable harnesses are involved.

Creating this enlarged cross section for the entrance of the plug into the socket, compared to the prior art versions, can be done especially advantageously if the plug and/or socket have ramplike bearing faces that slide on one another; because of these faces, the insertion motion is converted into a height offset that is oriented perpendicularly to this motion; then, with the aid of this offset, in the final analysis both the final detent locking and the contacting of the conductor portions are achieved.

BRIEF DESCRIPTION OF THE DRAWINGS

Preferred exemplary embodiments of the plug connector of the invention will now be described in conjunction with drawings, in which:

FIGS. 9E and 9F are perspective views of the second variant with the plug and socket in the same states as in FIGS. 9A and 9B, respectively;

DESCRIPTION OF THE PREFERRED EXEMPLARY EMBODIMENT

Figure 1A:
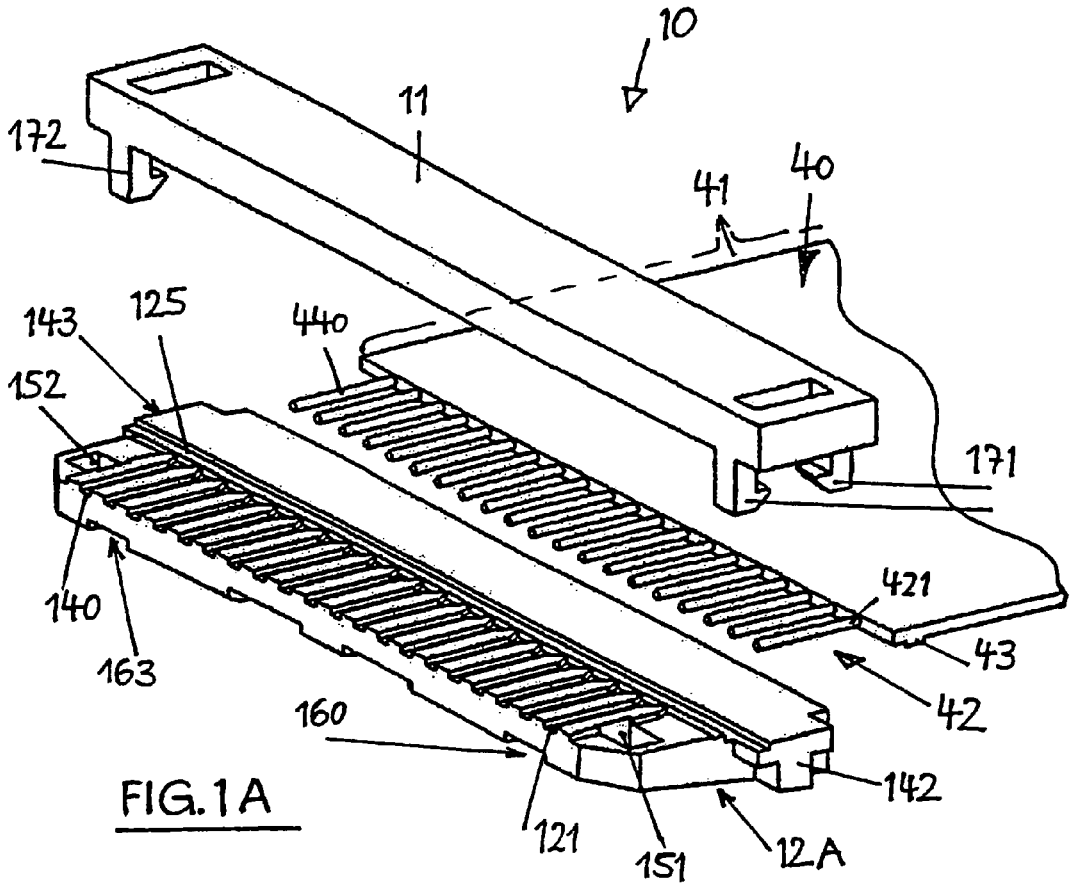
FIG. 1A is an exploded perspective view of the plug according to a primary embodiment of the invention.

The first exemplary embodiment of the plug connector shown in FIGS. 1–6 comprises, first, a plug 10, with the aid of which a ribbon cable 40, having a contact portion 42 with 20 first conductor portions 421 . . . 440 for making a connection, is furnished, and, second, a socket 20, which furnishes a number of contacts, in the form of 20 second conductor portions 521 . . . 540, corresponding to the number of first conductor portions 421 . . . 440 of the contact portion 42. Once the plug connector has been assembled, each of the first conductor portions 421 . . . 440 of the contact portion 42 of the ribbon cable 40 is thus in electrically conductive contact communication with the particular second conductor portion 521 . . . 540 in the socket 20 associated with it.

The conductor portions 421 . . . 440 of the contact portion 42 are insulated from the ribbon cable 40, in the exemplary embodiment described below. However, they may also be formed by the end portion of a ribbon cable embodied in the form of a printed foil.

The plug 10 (FIG. 1) has a lower part 12, in the form of an injection-molded plastic part, whose shaping is intended primarily to position the ribbon cable 40 in stationary fashion and to position the first conductor portions 421–440 in stationary fashion in a corresponding number of first channels 121 . . . 140. To this end, a plastic support 43 is glued to the underside of the ribbon cable 40 and cooperates with a transversely extending face-end edge 125 of the lower part 12, so that once the ribbon cable 20 rests flatly on the lower part 12, an unambiguous positioning is assured. The lower part 12 is embodied as slightly wedge-shaped, forming a first bearing face F12.

Also formed into the underside of the lower part 12 are guide channels 160 . . . 163, which cooperate with retaining tongues on the lower part 22 of the socket 20, as will be described in further detail hereinafter, and as seen for instance from FIG. 3B.

On each of its lateral end faces, the lower part 12 forms a respective T-shaped extension 142, 143, which serves to connect to an upper part 11, also embodied as a plastic injection-molded part.

Figure 1B:
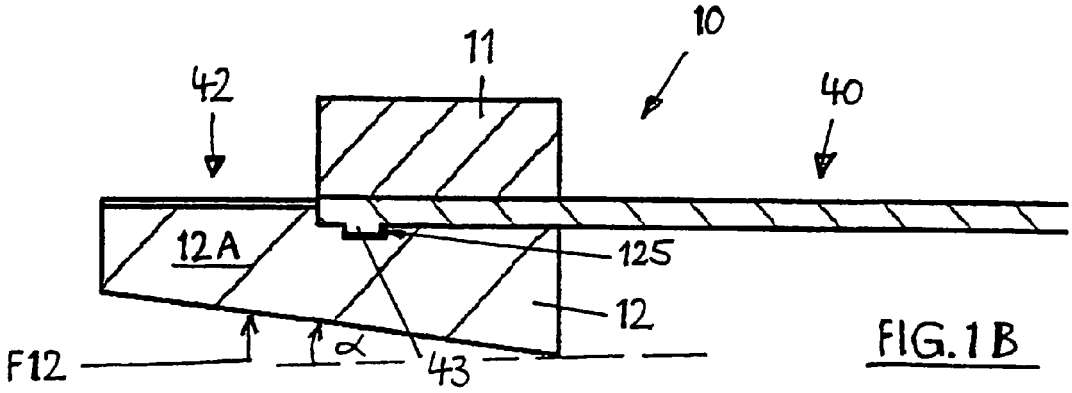
FIG. 1B is a cross sectional view of the assembled plug of FIG. 1A.

The upper part 11 essentially comprises a block-shaped bracket, onto whose end regions two downward-pointing pairs 171, 172 of detent hooks are formed, which are capable of engaging the extensions 142, 143 of the lower part 12 from below, so that once the ribbon cable 40 is put in place, it is retained in clamped fashion in the predetermined position between the upper part 11 and the lower part 12 (FIG. 1B). For axially positioning the ribbon cable 40 in the plug 10, channel-like profile sections (not shown) may be provided on the underside of the upper part 11; their number corresponds to the number of conductors of the ribbon cable, so that these profile sections rest on the face end of the jacket portion 41 of the ribbon cable 40. The plastic support 43 optionally together with these profile sections thus bring about an unambiguous positioning of the ribbon cable 40 and thus also of the first conductor portions 421 . . . 440 between the upper part 11 and the lower part 12 of the plug 10, which thus also assures an axial tension and compression relief of the contact portion 42.

Particularly from the illustration of the plug in FIG. 1B, in the thus-assembled state, it becomes clear that the front portion 12A of the lower part 12 of the plug 10 protrudes past the upper part 11 by precisely the length of the first conductor portions 421 . . . 440, that is, that the contact portion 42 formed by them is tailored to precisely this length, and the first conductor portions are each retained individually in the above-described first channels 121 . . . 140 of the lower part 12 in a way secured against lateral displacement.

These provisions assure that an unambiguously defined, immovable position of each of the first conductor portions 421–440 is assigned to every position of the plug 10 itself, which is significant for the technological success of the embodiment according to the invention.

Also provided on this front portion 12A of the lower part 12 protruding past the upper part 11 are two recesses 151, 152, in the lateral peripheral region, into which recesses a locking element can be introduced, as explained below.

The socket 20 (FIG. 2), which is disposed here on a circuit board 80, for instance, includes a lower part 22, which also acts as a contact holder for the second wire portions 521 . . . 540, so that these portions are retained by means of two channels 241 . . . 260 in a defined position and at a spacing relative to one another that corresponds to the spacing from one another of the first conductor portions 421 . . . 440 of the ribbon cable 40 fixed in the plug 10.

The lower part 22 of the socket 20 has two lateral first recesses 253, 254 with blocking tongues 251, 252, which only after they have been forced laterally away outward allow the aforementioned locking element to fit through, as will be described further hereinafter. Two middle, second recesses 263, 264 are also provided, into which retaining elements in the form of retaining tongues 261, 262 protrude, with nubs 261A, 262A pointing upward out of the second bearing face F22, which nubs cooperate with the guide channels 160 . . . 163 in the lower part 12 of the plug 10.

The portion of the lower part 22 pointing away from the wire portions 521 . . . 540 is embodied as slightly wedge-shaped, forming a second bearing face F22, which cooperates with the first bearing face F12 of the likewise wedge-shaped front portion 12A of the lower part 12 of the plug 10.

The upper part 21 of the socket is formed by a retaining plate, which is guided by means of bores 273, 274 on two positioning pegs 271, 272, disposed at the corners, of the lower part 22. The upper part 21 covers the second wire portions 521 . . . 540 and in its front region has a transversely extending groove 228, in which a U-shaped bracket 30 acting as a locking element is retained. The U-shaped bracket 30 has first, outer detent tongues 31, 32, pointing in the direction of the lower part 22, for engagement with lateral recesses 231, 232 in the lower part 22, and also has second, inner detent tongues 33, 34, which serve to provide locking once the plug 10 has been introduced.

Figure 2A:
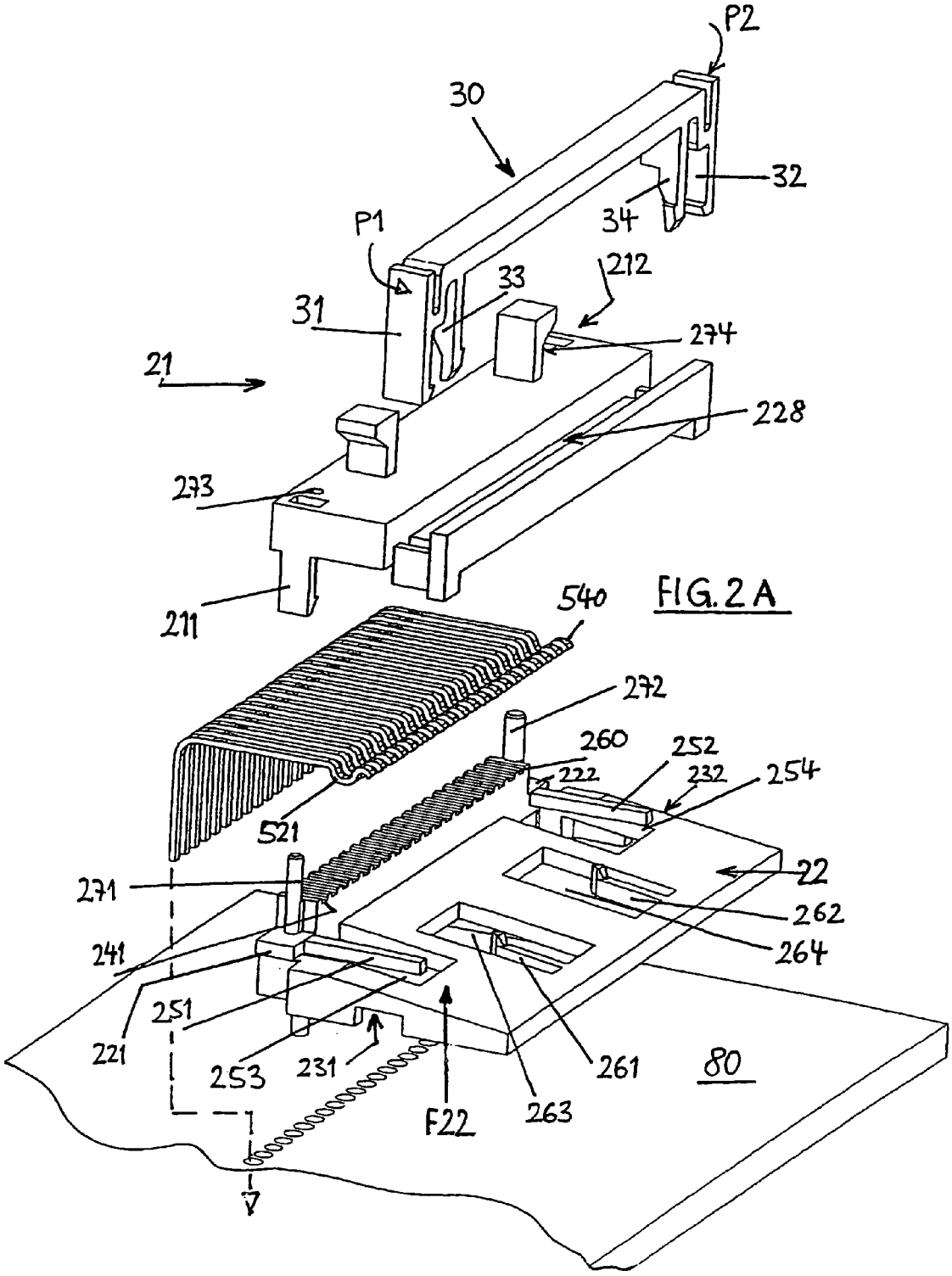
FIG. 2A is an exploded perspective view of the socket according to a primary embodiment of the invention.
Figure 2B:
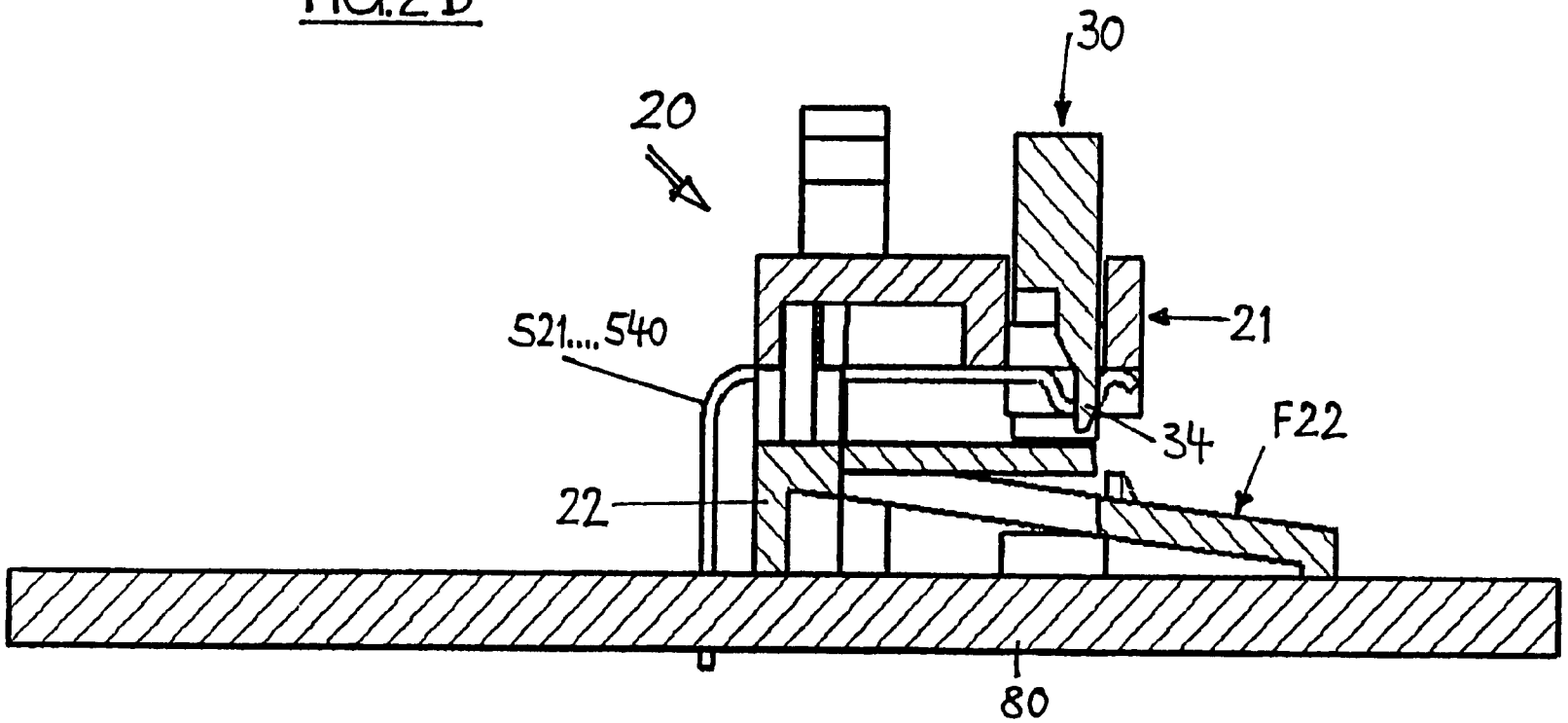
FIG. 2B is a cross sectional view of the assembled socket of FIG. 2A.

For connecting the upper part 21 and lower part 22 of the socket 20, detent tongues 211, 212 formed laterally onto the upper part 21 are also used; they engage lateral protrusions 221, 222 of the lower part 22 from below, resulting in the mounted state of the socket 20 as shown in FIG. 2B, in which the upper part 21 and lower part 22 are held together by the detent tongues 211, 212, and the U-shaped bracket 30 is retained by its detent tongues 31, 32 in the lower part 22.

Figure 3A:
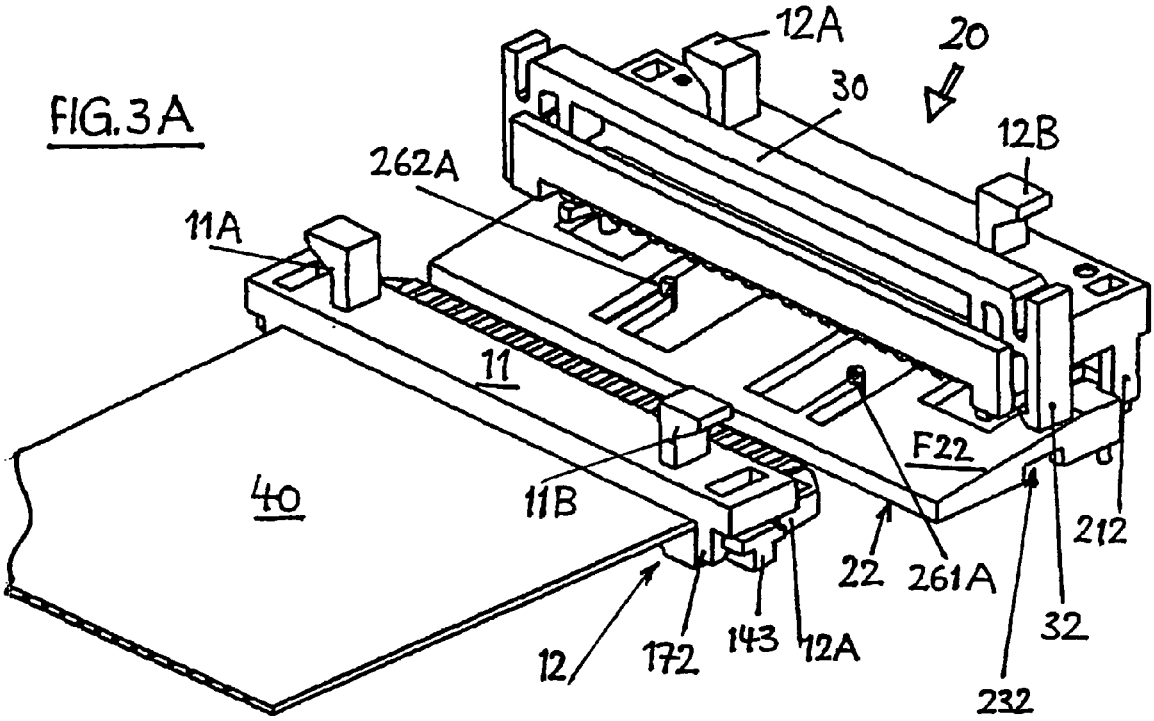
FIG. 3A is a perspective view, from above, of the entire plug connector prior to assembly.

For automatic manipulation of the plug and socket by means of a manipulating device, such as an industrial robot, the upper parts 11 and 21 have manipulating parts in the form of hook-shaped attachments 11A, 11B and 12A, 12B, respectively, as is shown in FIG. 3A.

Brief Description of the Function

For successive creation of prelocking, final detent locking and unlocking between the plug 10 and the socket 20, the components mentioned above are used as follows:

The two bearing faces F12, of the lower part 12 of the plug 10, and F22, of the lower part 22 of the socket 20, are inclined in complementary fashion, each by an acute angle $\alpha$, from the horizontal in such a way that when the socket 20 with the U-shaped bracket 30 placed on it is mounted, a virtually force-free introduction of the plug 10 into the socket 20 is assured, until, when an axial detent position R is reached, the nubs 261A, 262A of the retaining tongues 261, 262 engage an associated profile section 164, 165 in the guide channels 160 . . . 163 in the lower part 12 of the plug 10. In this prelocking position, the lower part 12 of the plug 10 has not yet pressed the two blocking tongues 251, 252 in the lower part 22 of the socket 20 outward out of the way, so that the second detent tongues 33, 34 of the U-shaped bracket that are intended for the final detent locking cannot yet reach through the lower part 12 of the plug 10. Only upon further advancement of the plug 10 are the blocking tongues 251, 252 pressed laterally out of the way by the chamfered corner regions of the front portion 12A, so that when the final locking position is reached, the two second recesses 151, 152 in the plug 10 are uncovered, for access by the second, inner detent tongues 33, 34 of the U-shaped bracket 30 through the lower part 22 and through the recesses 253, 254 for detent locking on the underside of the plug 10 in the recesses 151, 152.

When the connection is unlocked, the shaping of the guide channels 160 . . . 163 between the plug 10 and the U-shaped bracket 30, when the first detent tongues 31, 32 are pressed on and the U-shaped bracket 30 is pulled upward out of the way, has the effect that detent locking in the prelocking position when the plug 10 is pulled out of the socket 20 is avoided, so that the sequence of motion is different upon introduction into and removal from the socket 20.

Description of the Functional Positions

The positions of the plug 10 and socket 20 will be described in further detail below: in FIGS. 4–6, only the reference numerals that identify components of functional significance in the applicable position are shown:

Plug and Socket, Assembled (FIG. 3):

The upper part 11 of the plug 10 is solidly joined to the lower part 12; the two pairs 171, 172 of detent tongues engage the two horizontal portions of the T-shaped extensions 142, 143 from below. Thus the ribbon cable 40 is fixed between the upper part 11 and lower part 12 in such a way that its contact portion 42 is positioned on the front portion 12A, which before the introduction is oriented in the direction of the socket 20.

Accordingly, the top part 21 of the socket 20 is joined to the lower part 22 because the two lateral detent tongues 211, 212 of the upper part 21 engage the associated lateral protrusions 221, 222 of the lower part 22 from below.

The U-shaped bracket 30 is in turn retained on the lower part 22 because its detent tongues 31, 32 snap into the lateral recesses 231, 232 of the lower part 22. In FIG. 3A, the U-shaped bracket 30 and upper part 21 are shown in the preliminary position ready for assembly, while in the bottom view in FIG. 3B, the upper part 21 and U-shaped bracket 30 have been locked together in detent fashion, as can be seen from the lateral engagements of the detent tongues 31, 32 and 211, 212, respectively.

Figure 3B:
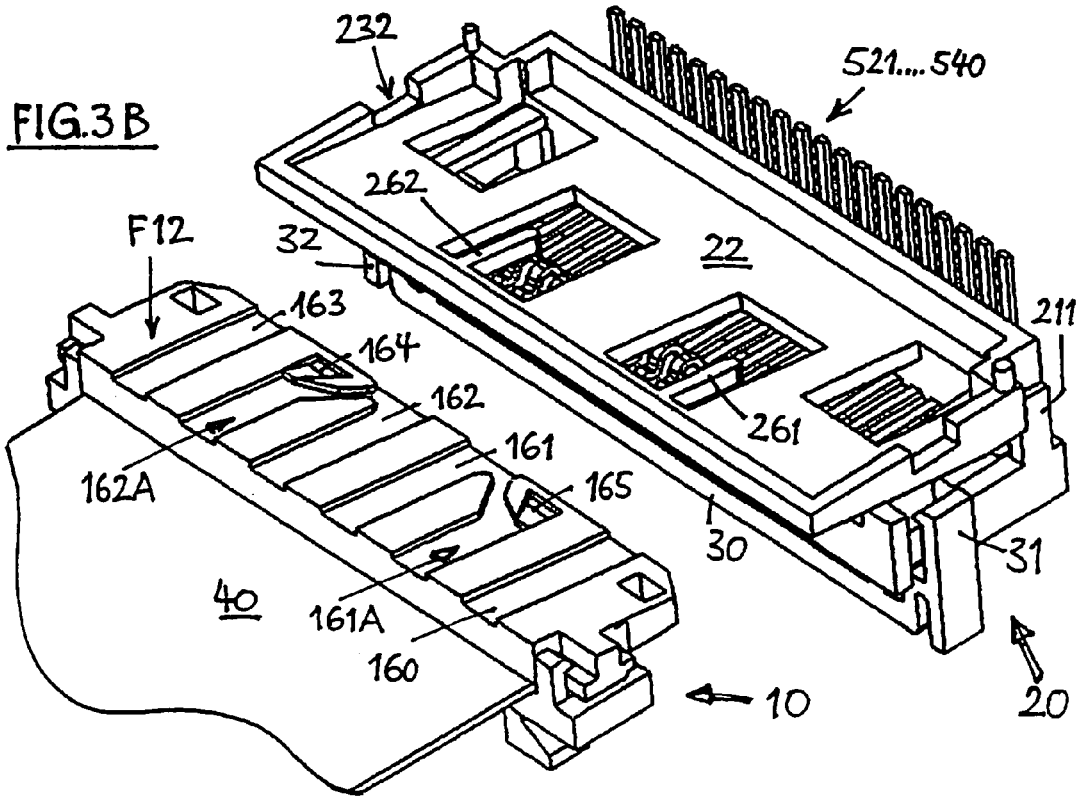
FIG. 3B is a perspective view, from below, of the entire plug connector prior to assembly.

Accordingly, in the position shown in FIGS. 3A and 3B, the plug 10 is ready for insertion into the socket 20. It is significant here that upon this insertion motion, the bearing face F12 of the plug 10 slides onto the bearing face F22 of the socket 20 in ramplike fashion in the manner of a steep plane; as a result, the axial plugging-in motion of the plug 10 into the socket 20 is at the same time converted into a vertical displacement of the plug 10 toward the socket 20, and thus in particular is also converted into a vertical displacement of the first conductor portions 421 . . . 440 toward their respective associated "contact partners" beneath the second conductor portions 521 . . . 541 in the socket 20.

Because of the ramplike construction achieved by means of the complementary bearing faces F12 and F22, the plug upon contacting the socket 20 has not only axial play but also, to a certain extent, vertical play as well, so that for a first positioning of the plug 10 relative to the socket 20 at the onset of the plug-in operation, no particularly precise relative locational orientation of these two components relative to one another needs to be accomplished, which particularly in automated operations is of substantial significance, but is also significant in manual assembly of the plug 10 and socket 20, since the only slight precision required at the onset of the plug-in operation can be achieved correspondingly quickly and thus inexpensively.

Prelocking Position (FIG. 4):

Along the way to making contact, the prelocking position already mentioned at the outset is provided, whose essential function can be seen from the retaining tongues 261, 262 with their detent nubs 261A, 262A, in cooperation with the guide channels 161/161A and 162/162A on the bearing face F12 of the plug 10.

Figure 4A:
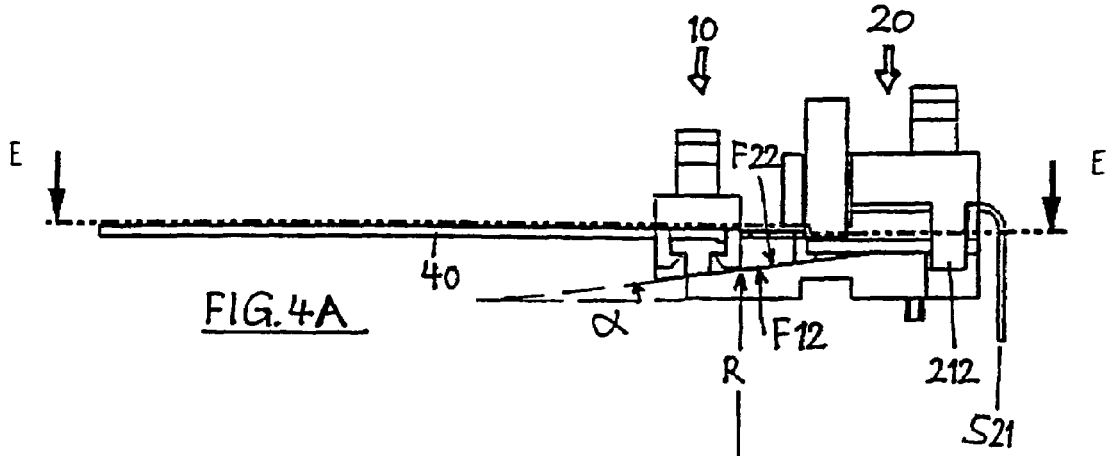
FIG. 4A is a side view of the plug connector in the prelocking position.
Figure 4B:
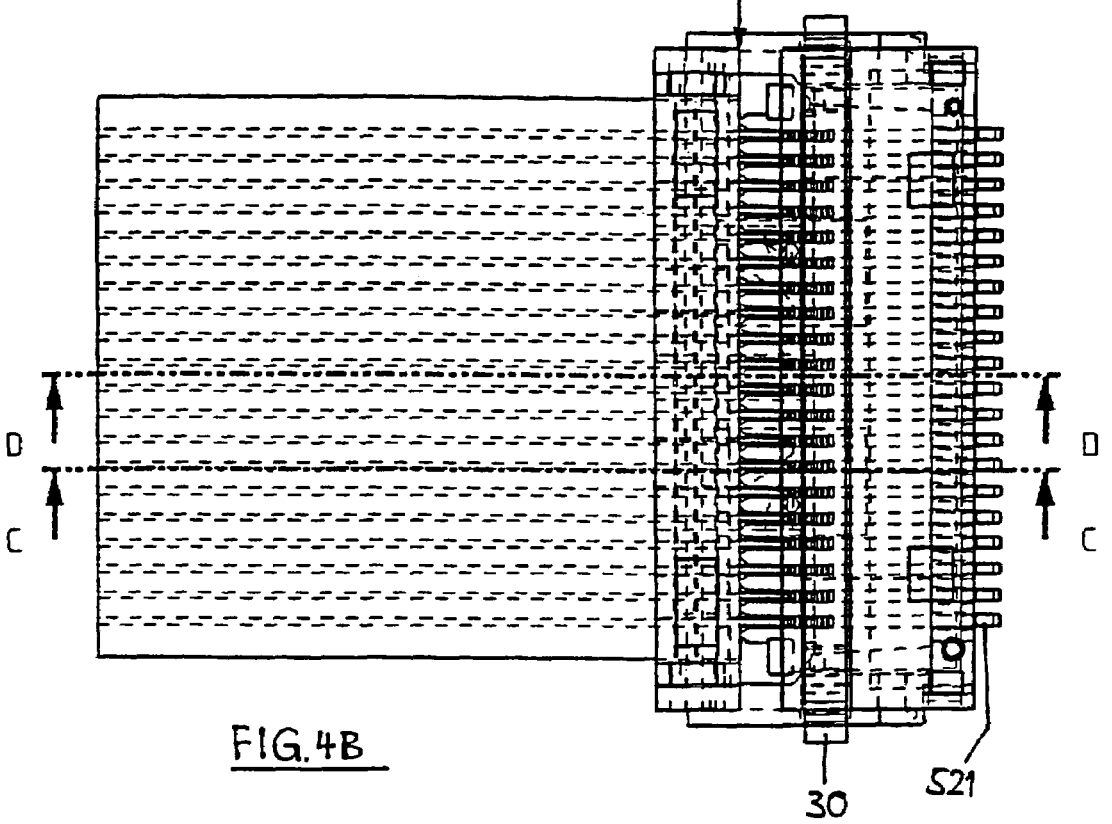
FIG. 4B is a top view of the plug connector of FIG. 4A.
Figure 4C:
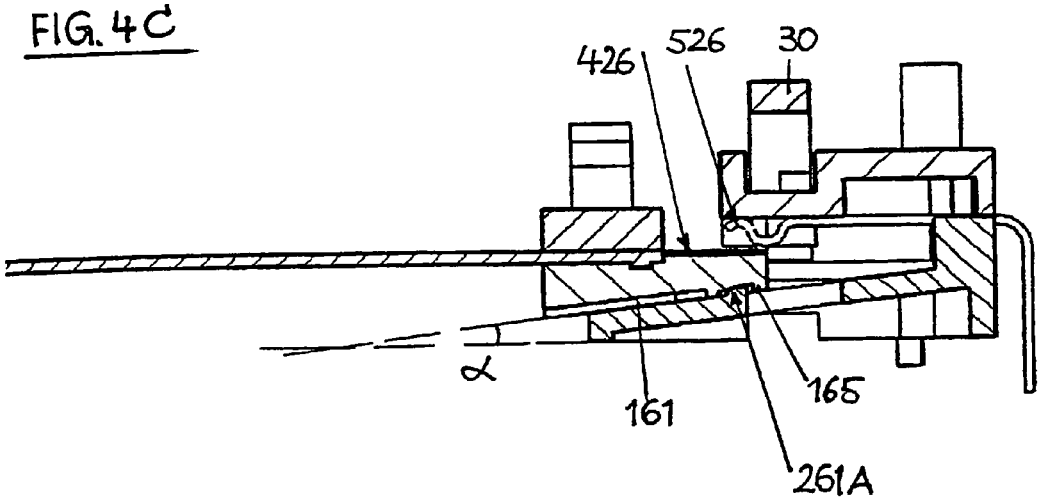
FIG. 4C is a cross-sectional view along plane C—C of FIG. 4B.
Figure 4D:
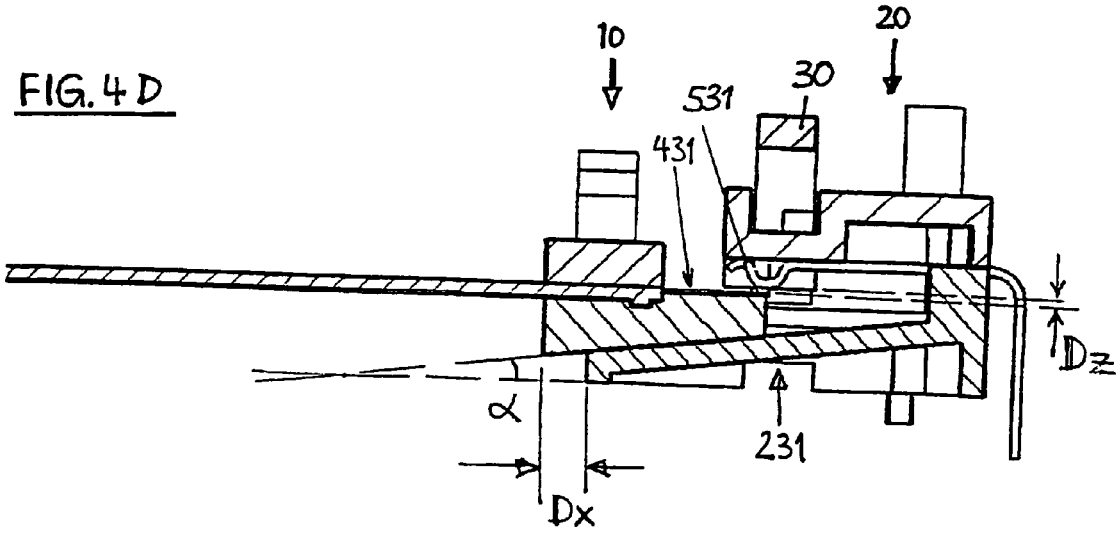
FIG. 4D is a cross-sectional view along plane D—D of FIG. 4B.

Once the prepared plug-in operation has been performed, the plug 10 with the ribbon cable 40 reaches a certain axial position relative to the socket 20, which is designated in FIG. 4A as the prelocking position R, for which the face-end edge of the upper part 11 of the plug 10 is meant to be the yardstick. The two bearing faces F12 and F22 rest on one another; the U-shaped bracket 30 is not yet in engagement with the lower part 22 of the socket 20. This position is reached by providing that (FIGS. 4C and 4F) the two retaining tongues 261 and 262, with their nubs 164 and 165, lockingly engage a steplike profile section 164, 165 at the beginning of the detent channel 161A and 162A (FIG. 3B) from behind, and thus in this position the prelocking of the plug 10 in the socket 20 is achieved.

This prelocking position R is located previous to the axial final locking position by the distance Dx (FIG. 4D), and accordingly the surface of the contact portion 42 with the conductors 421 . . . 440 of the plug 40 is located at a vertical spacing Dz from the underside of the curved contact portion of the associated conductor portions 521 . . . 540 of the socket 20; between these two values, because of the angle of inclination $\alpha$ of the slide-on ramp, the relationship is expressed as $Dz=(Dx)\times(\sin\alpha)$. Here, the vertical play Dz is selected to be less than the depth to which the nubs 261A, 262A of the retaining tongues 261, 262 plunge into the profile sections 164, 165. Since the second conductor portions 521 . . . 540 cannot escape upward, the consequence is that the plug 10 can no longer be pulled out of the socket 20, once the prelocking position R has been reached and the retaining tongues of the socket have snapped into the profile sections of the plug. Naturally, this also means that a stable relative positioning of the plug 10 and socket 20 is assured, which in this sense can also be called a securing position.

Figure 4E:
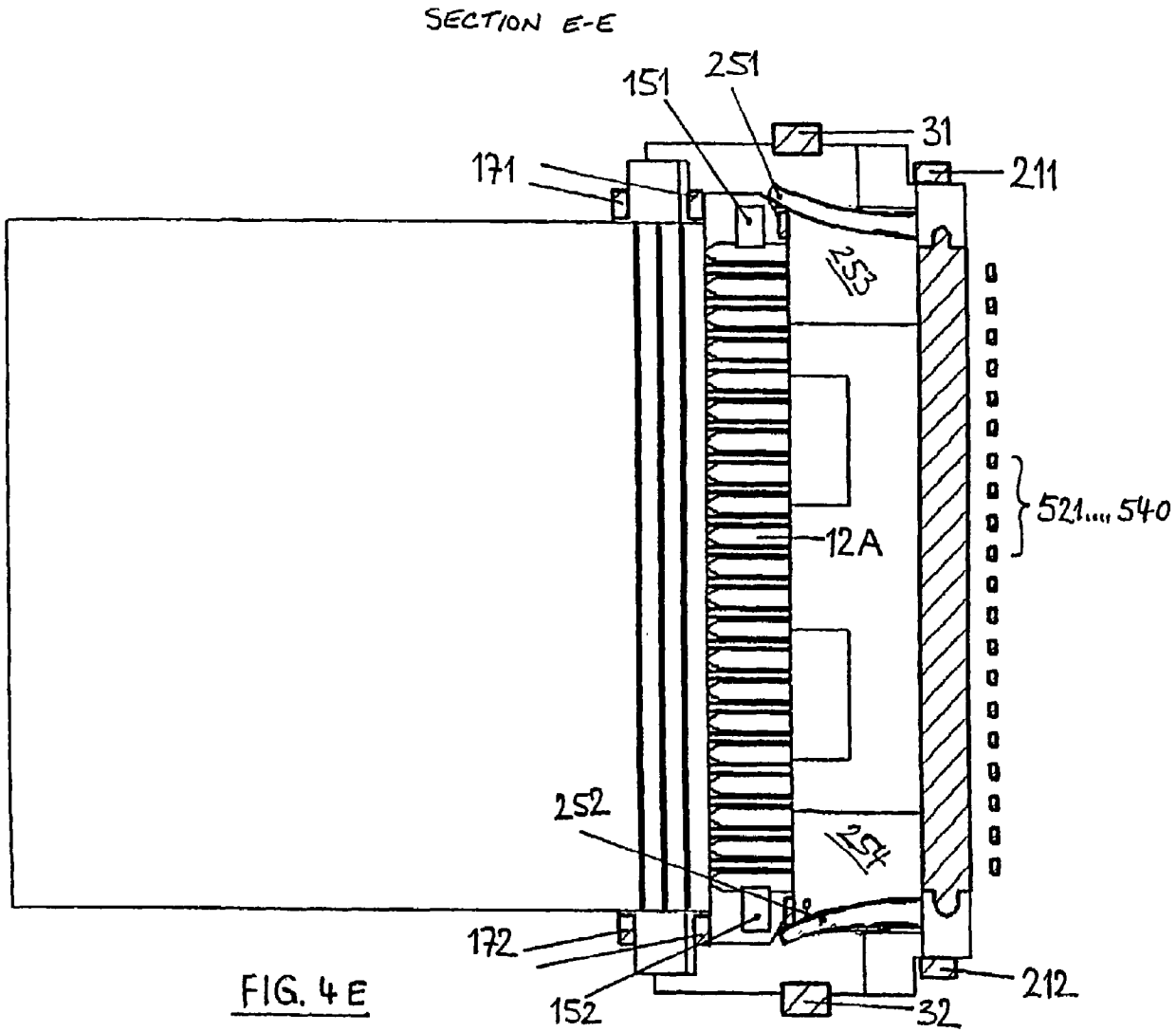
FIG. 4E is a cross-sectional view along plane E—E of FIG. 4A.
Figure 4F:
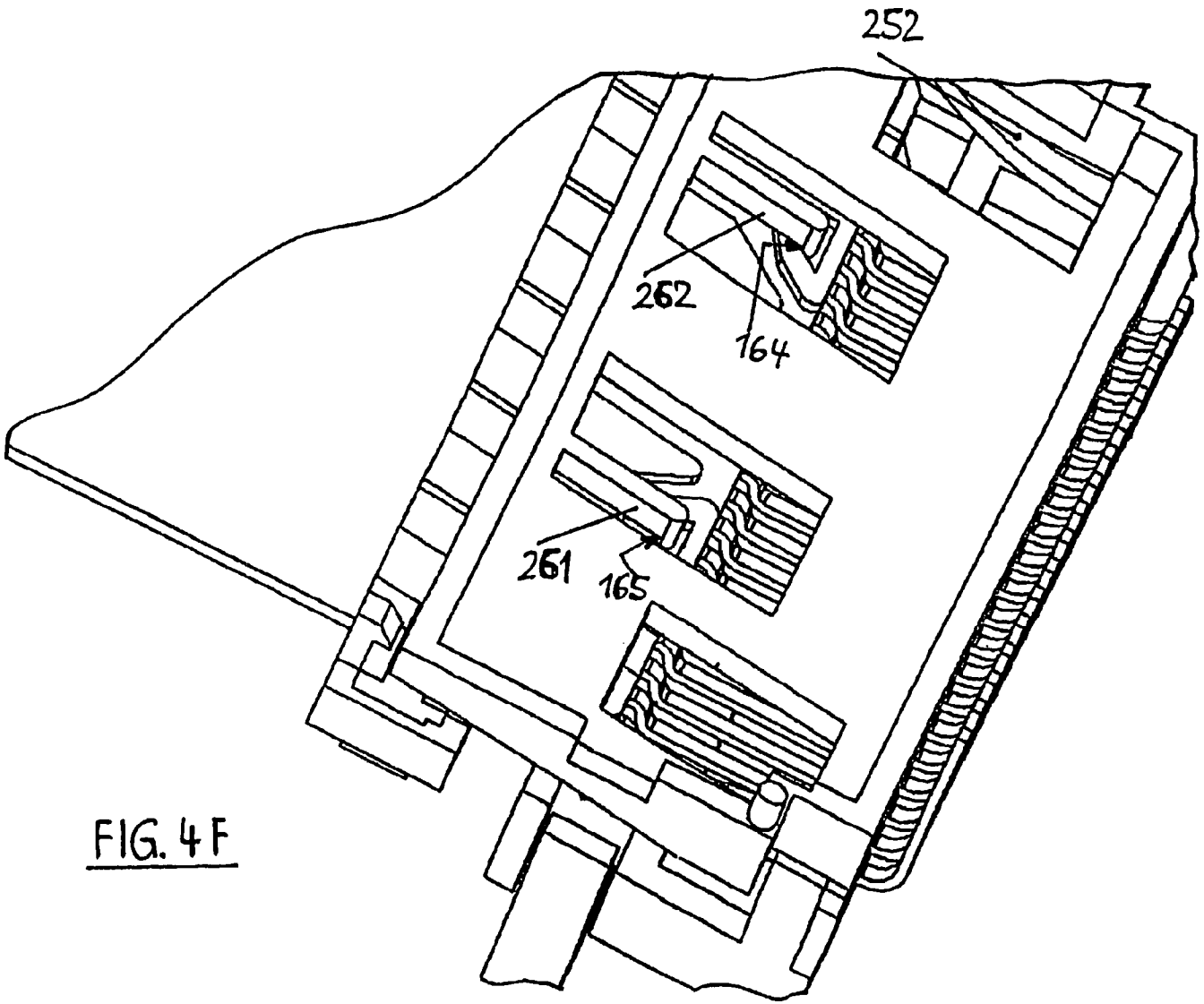
FIG. 4F is a fragmentary view of the plug connector of FIG. 4A, viewed from below.

In this prelocking position, the U-shaped bracket 30 is still in its standby position; that is, its inner detent tongues 33, 34 cannot be pressed downward yet, since the corresponding recesses 253, 254 in the lower part 22 are still blocked by the blocking tongues 251, 252, whose front end, in the prelocking position, only now comes into contact with the chamfered corner portions of the front portion 12A of the plug 10 (FIG. 4E). Consequently, the actuation of the U-shaped bracket 30 in the prelocking position is blocked and continues to be reserved for the final locking position described below.

Final Locking Position (FIG. 5):

For reaching the final locking position E (FIGS. 5A and 5B), the plug 10 is thrust out of the prelocking position V farther into the socket 20, until, in the exemplary embodiment shown, the rear edge of the upper part 11 is aligned with the front edge of the lower part 22, so that now Dx=0. In this motion, the retaining tongues 261, 262 slide over ramplike slide-on faces 164A, 165A (FIG. 5F) away from the profile sections 164, 165 and thus reach the portion of the guide channel 161A and 162A, respectively, pointing toward the ribbon cable 40 (FIG. 3B).

Figure 5A:
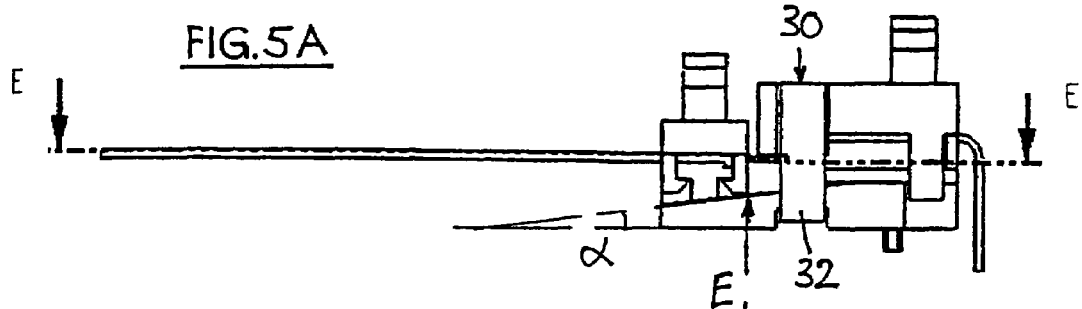
FIG. 5A is a side view of the plug connector in the final locking position.
Figure 5B:
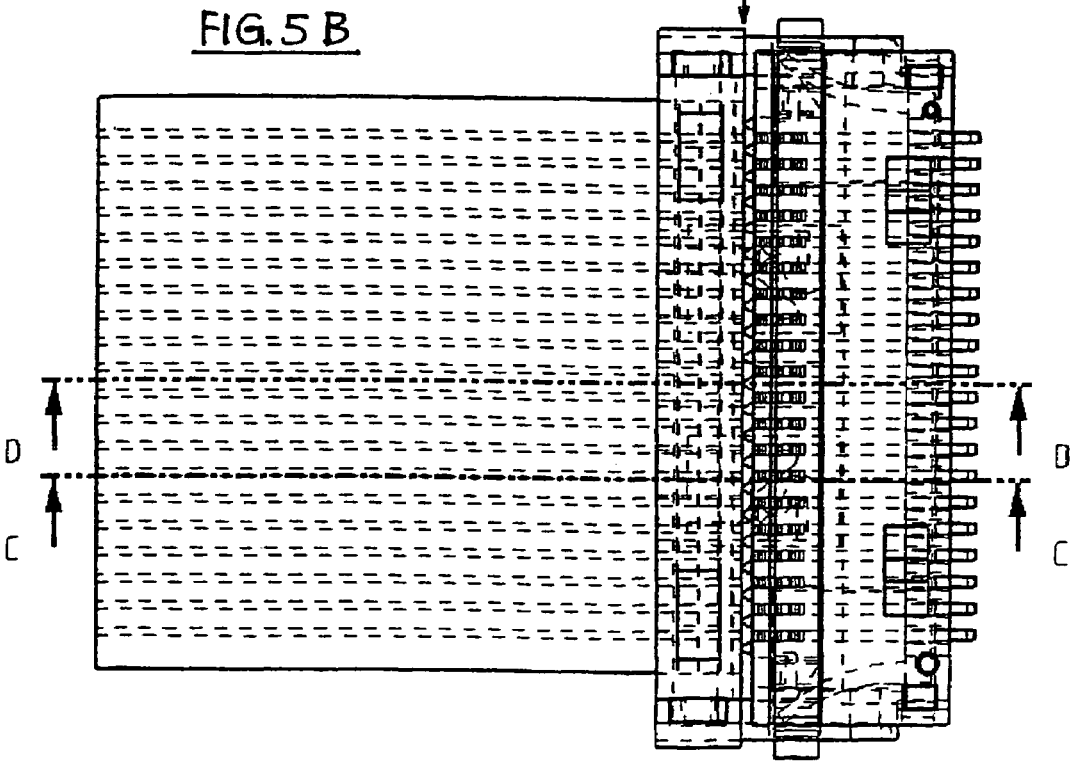
FIG. 5B is a top view of the plug connector of FIG. 5A.
Figure 5C:
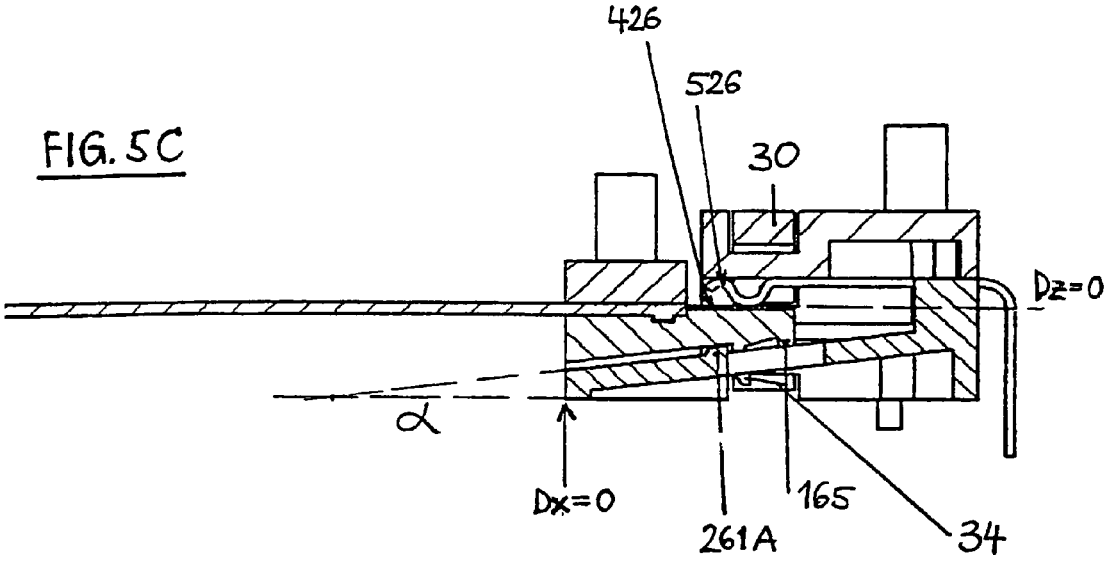
FIG. 5C is a cross-sectional view along plane C—C of FIG. 5B.
Figure 5D:
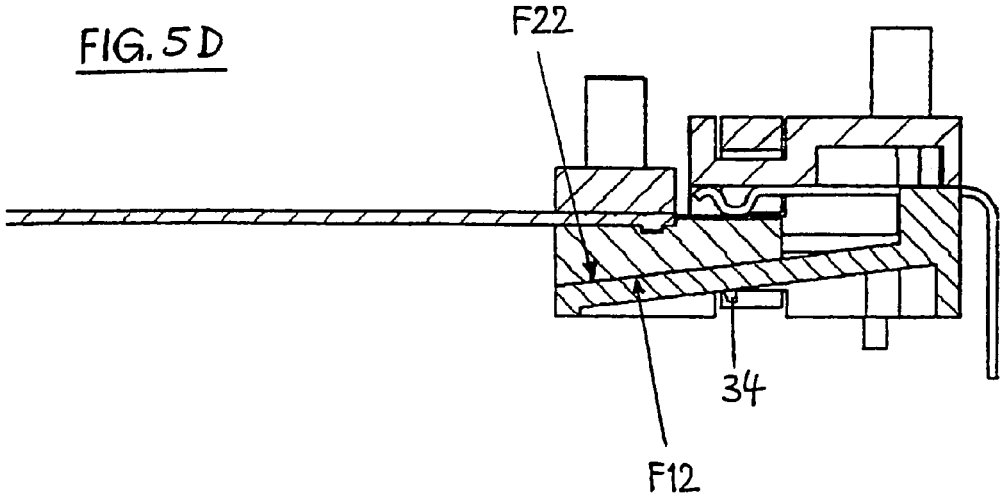
FIG. 5D is a cross-sectional view along plane D—D of FIG. 5B.
Figure 5E:
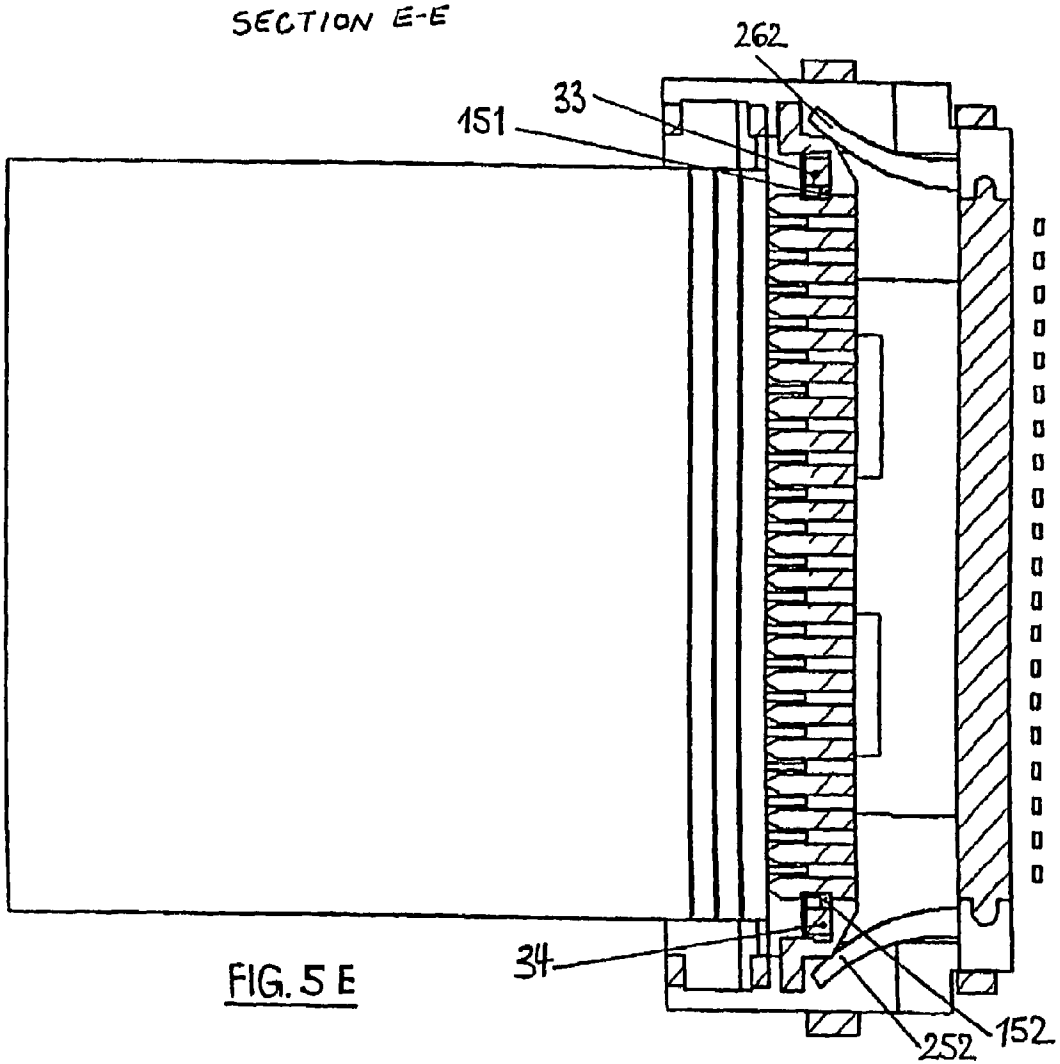
FIG. 5E is a cross-sectional view along plane E—E of FIG. 5.
Figure 5F:
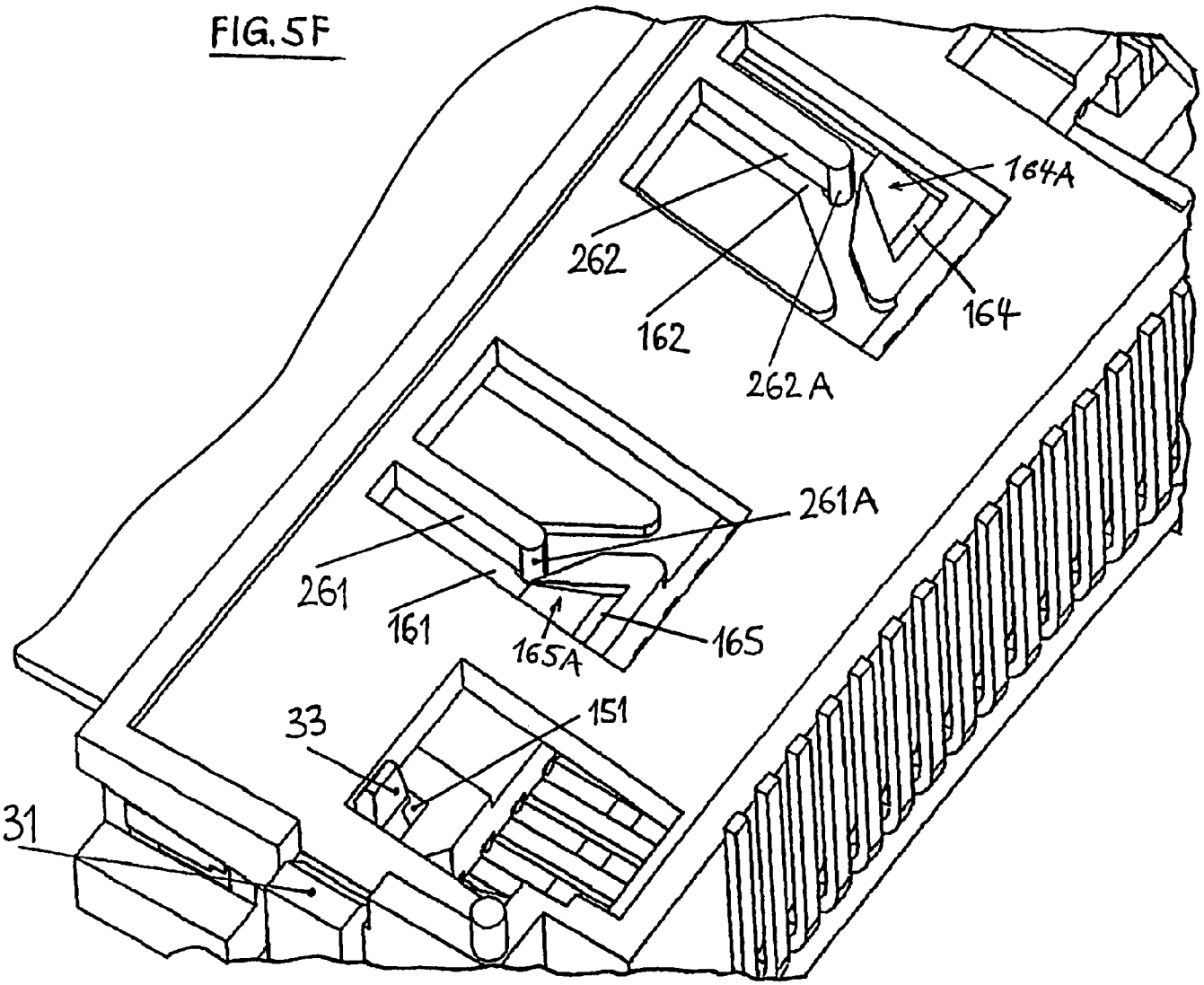
FIG. 5F is a fragmentary view of the plug connector of FIG. 5A, viewed from below.
Figure 6A:
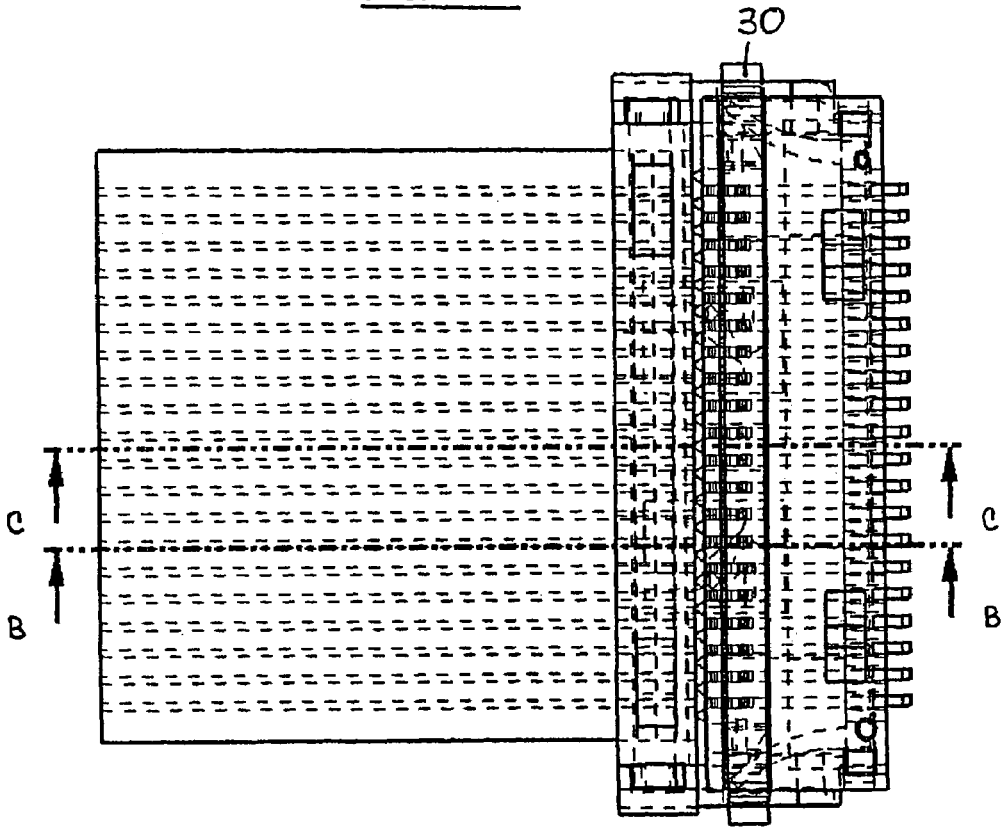
FIG. 6A is a top view of the plug connector in the unlocking position.
Figure 6B:
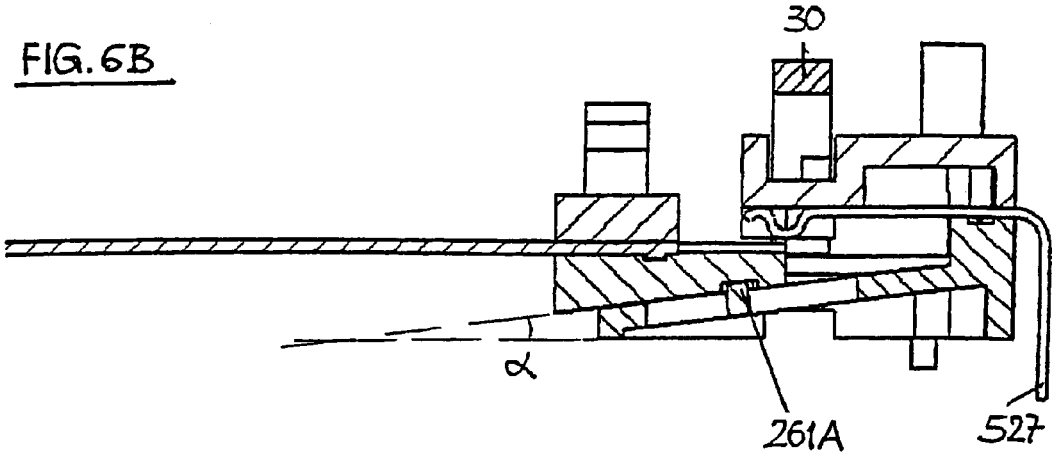
FIG. 6B is a cross-sectional view along plane B—B of FIG. 6A.
Figure 6C:
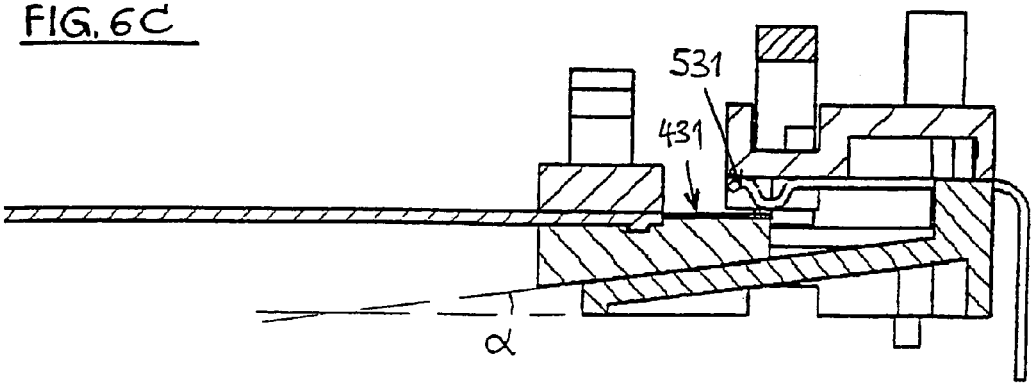
FIG. 6C is a cross-sectional view along plane C—C of FIG. 6A.
Figure 6D:
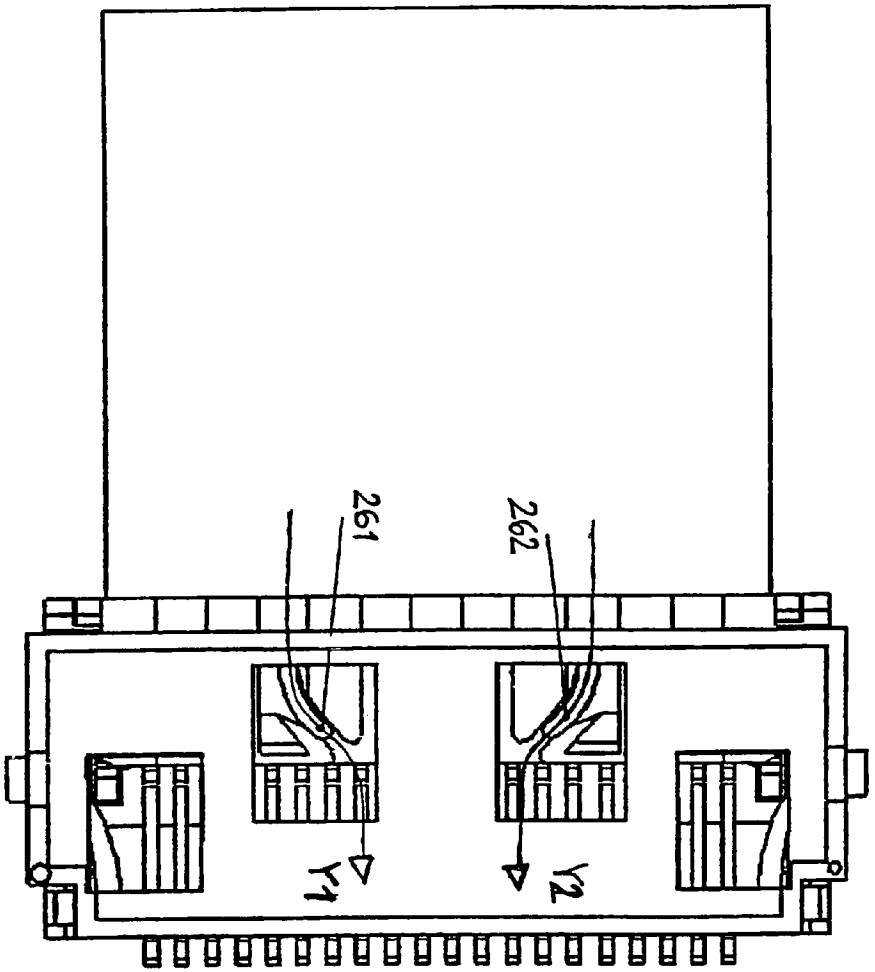
FIG. 6D is a top or bottom plan view of the plug connector of FIG. 6A.
Figure 6E:
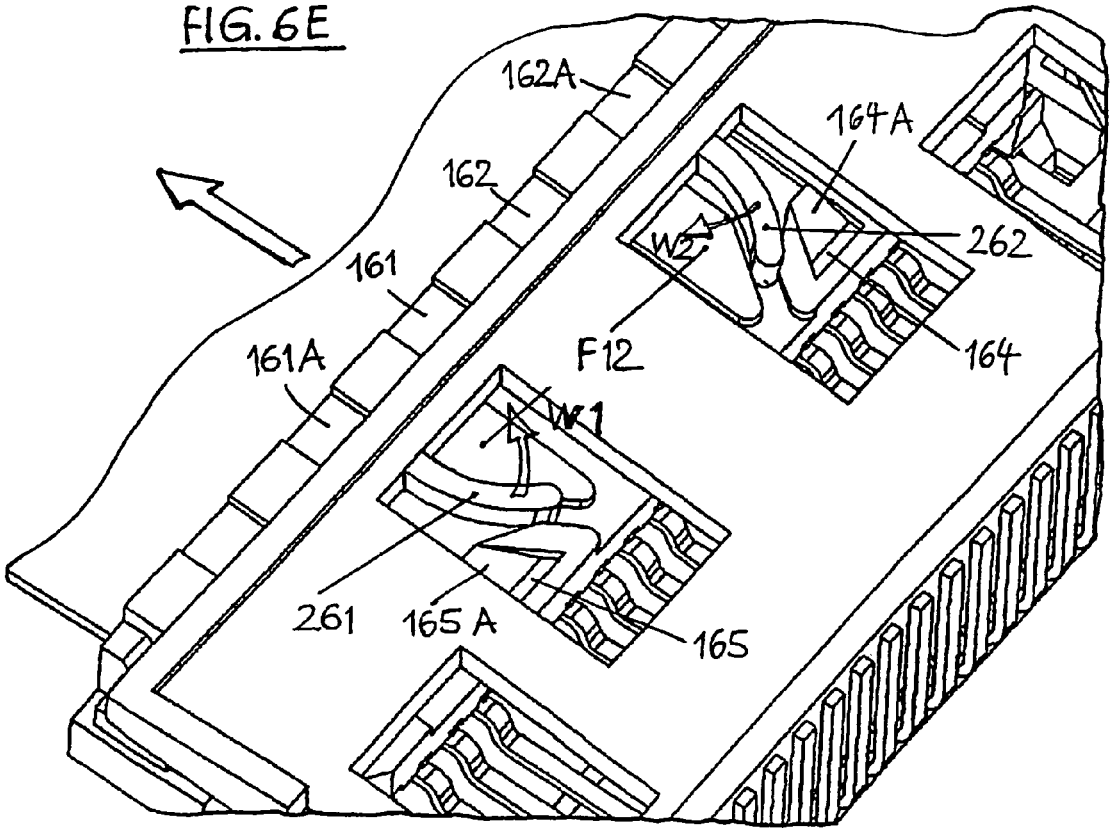
FIG. 6E is a fragmentary view of the plug connector of FIG. 6*a*, viewed from below.

Also associated with the axial displacement of the plug 10 into the socket 12 from the prelocking position to the final locking position E, because of the ramplike sliding-on motion already explained, is a corresponding vertical motion component, such that now, the play or spacing Dz between the first conductor portions 421 . . . 440 and the second conductor portions 521 . . . 540 also becomes zero; that is, in the final locking position E, the contact position of the conductor portions of the plug 10 and socket 20 is simultaneously established as well. In this axial relative position between the plug 10 and the socket 20, the inner detent tongues 33, 34 of the U-shaped bracket 30 are now also located above the lateral recesses 151, 152 in the front portion 12A of the plug 10; blocking is no longer being performed by the blocking tongues 252, 262, since they have been bent farther to the side by the farther-advanced front portion 12A (FIG. 5E). The contact position can now accordingly be assured by depressing the U-shaped bracket 30, until the inner detent tongues 33, 34 engage the recesses 151, 152 from below and lock there in detent fashion. Thus the plug connection is established in both a mechanical and an electrical sense.

Unlocking Position (FIG. 6):

If the connection between the plug 10 and the socket 20 is to be released again, then pressure is exerted on the continuation, on both sides, of the outer detent tongues 31, 32, approximately at the points marked P1 and P2 in FIG. 2A, so that because of the rockerlike support of the detent tongues 31 and 32, the lower end of the detent tongues 31 and 32 with the formed-on detent lugs are put out of engagement with the lower part 22 of the socket 20 in the region of the recesses 231, 232, and the U-shaped bracket 30 can be pulled upward and away. Once this position is reached, the plug 10 can be pulled out of the socket 20; in FIG. 6 the axial position for pulling the plug out that corresponds to the prelocking position V upon insertion of the plug 10 into the socket 20 is shown. Because of the design of the guide channels 161, 161A, 162, 162A in the bearing face F12, and in particular because of the aforementioned provision of the ramplike slide-on faces 164A and 165A (FIG. 6E), it is attained that the rounded face ends of the retaining tongues 261, 262, because of their flexible design, are passed around the detent profile sections 164, 165 (bending arrows W1 and W2) by means of an obliquely extending "bypass" between the contact channels 162 and 162A, and 161 and 161A. Accordingly, this construction assures that once the locking is released by pulling out the U-shaped bracket 30, the plug 10 can be removed completely from the socket 20 without major resistance.

DESCRIPTION OF VARIANTS OF THE PREFERRED EXEMPLARY EMBODIMENT

Figure 7B:
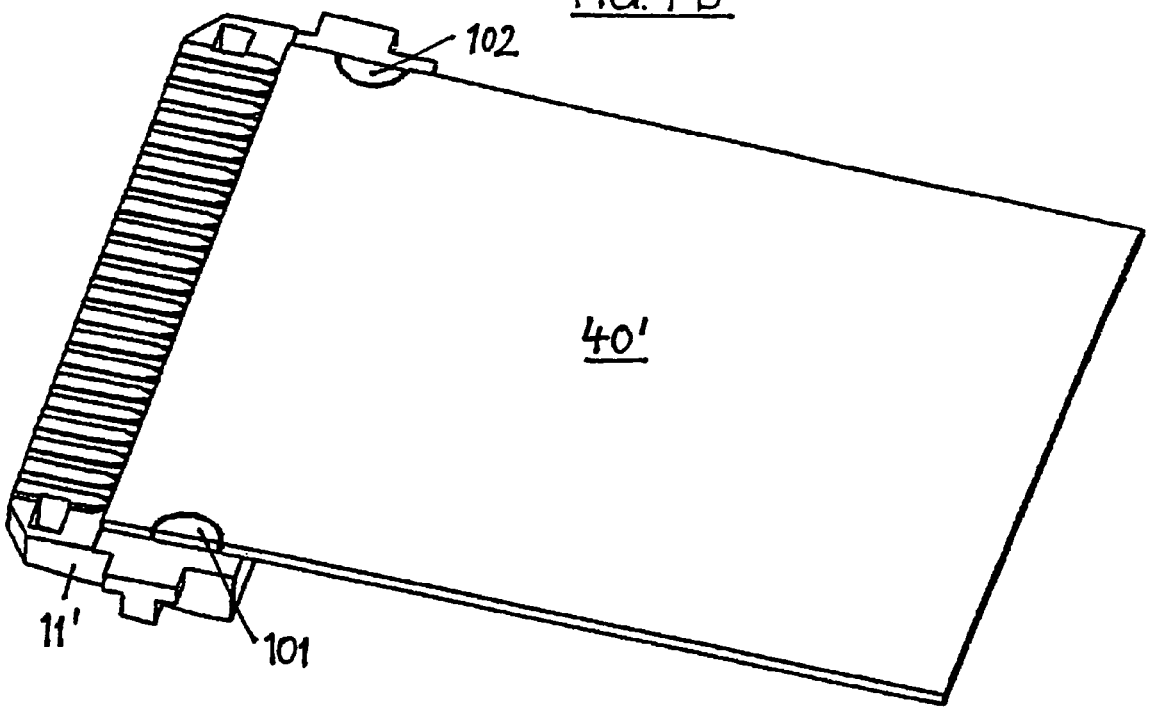
FIG. 7B is a perspective view of the lower part of the plug with the ribbon cable of FIG. 7A in place.
Figure 7A:
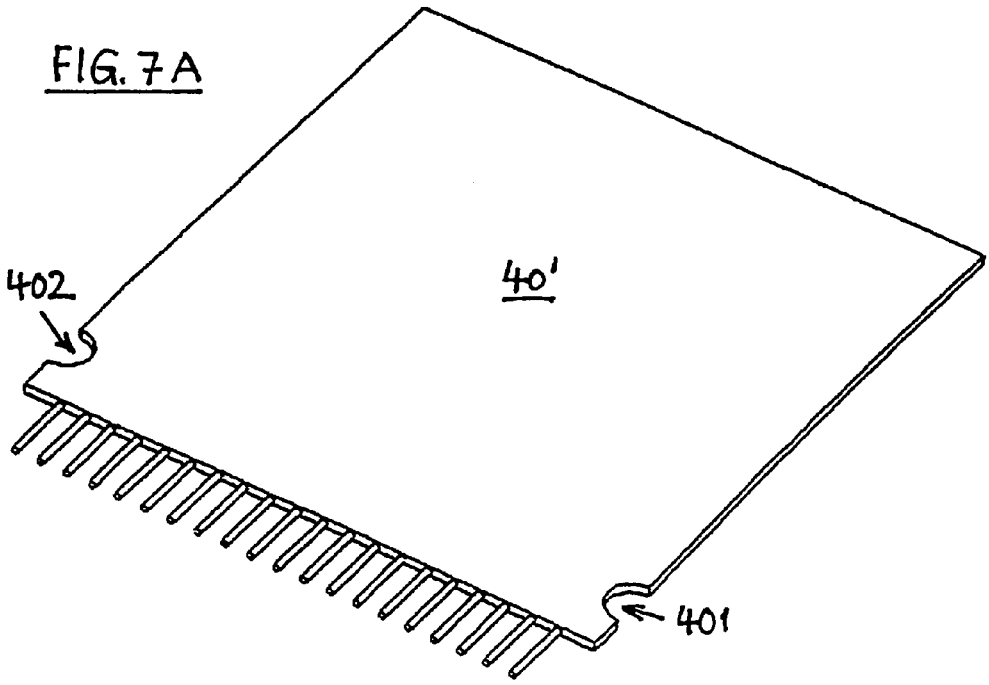
FIG. 7A is a perspective view of the end portion of a ribbon cable according to a variant of the primary embodiment.

The above-described axial fixation of the ribbon cable 40 in the plug 10 (FIG. 1) can be achieved alternatively or additionally with the variant shown in FIG. 7:

To this end, the ribbon cable 40' has lateral notches or recesses 401 and 402, which are disposed along with complementary pegs or nubs 101 and 102 on the lower part 11' of the plug. The face-end edges of associated recesses/nubs that do not point in the thrust direction bring about the transfer of axial thrust and tension stresses from the ribbon cable 40' into the lower part 11' of the plug.

Description of Variants for Shifting the Plug from the Prelocking Position into the Final Locking Position.

Instead of the further insertion of the ribbon cable 40 into the socket 20, it is also possible to use the U-shaped bracket 30' to create this forward thrust, which has advantages particularly if this operation is automated.

Figure 8A:
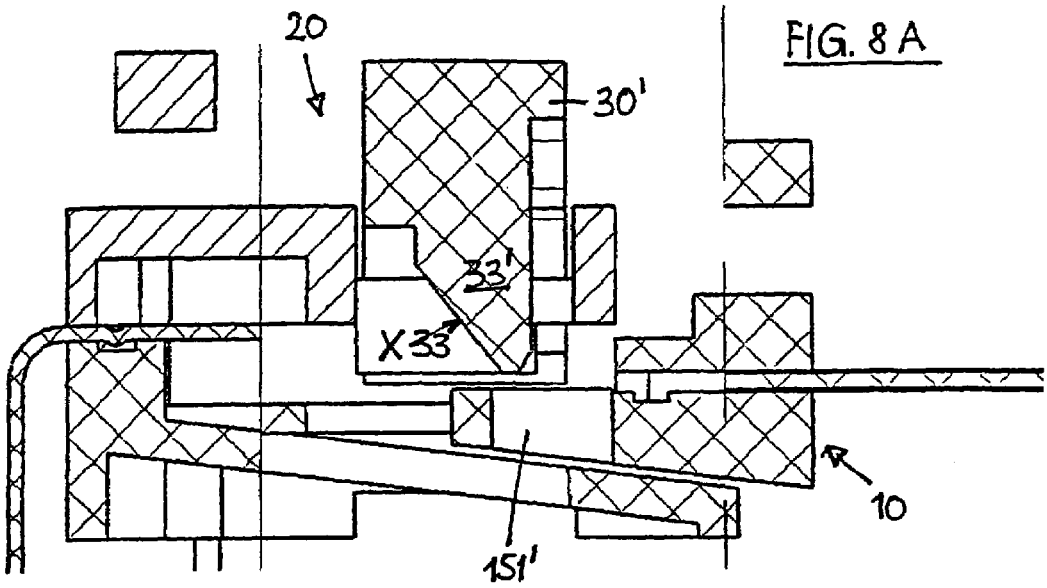
FIG. 8A is a cross-sectional view of the socket of a first variant of the plug and socket showing an embodiment of a U-shaped bracket as an actuating element for forward thrust of the ribbon cable from a prelocking position.
Figure 8B:
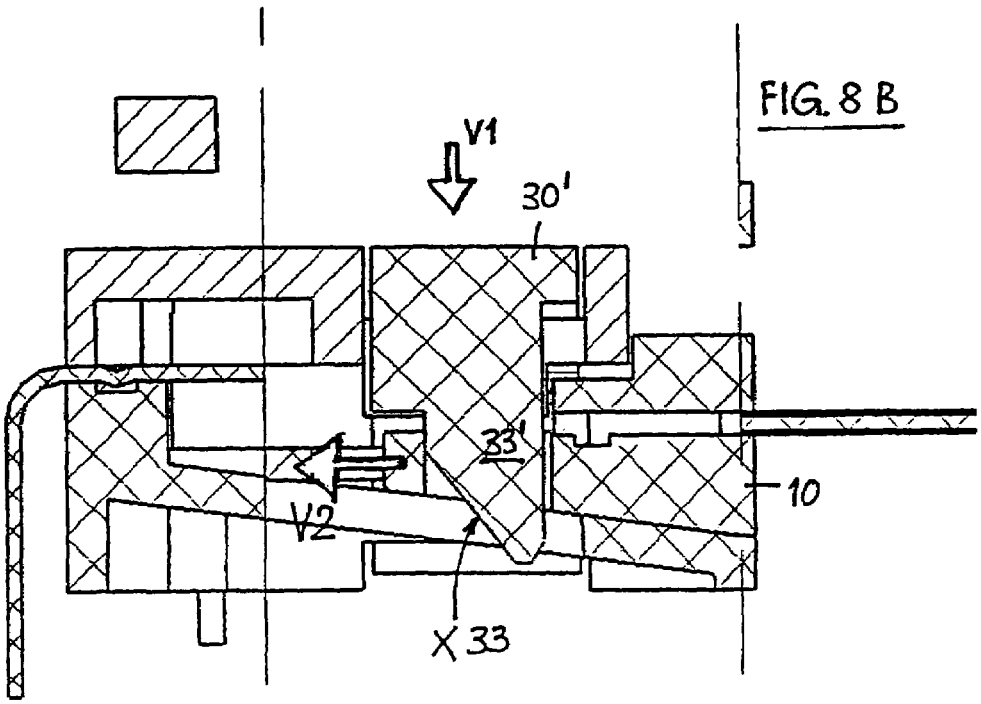
FIG. 8B is a cross-sectional view of the socket of FIG. 8A with the actuating element in the final locking position.
Figure 9A:
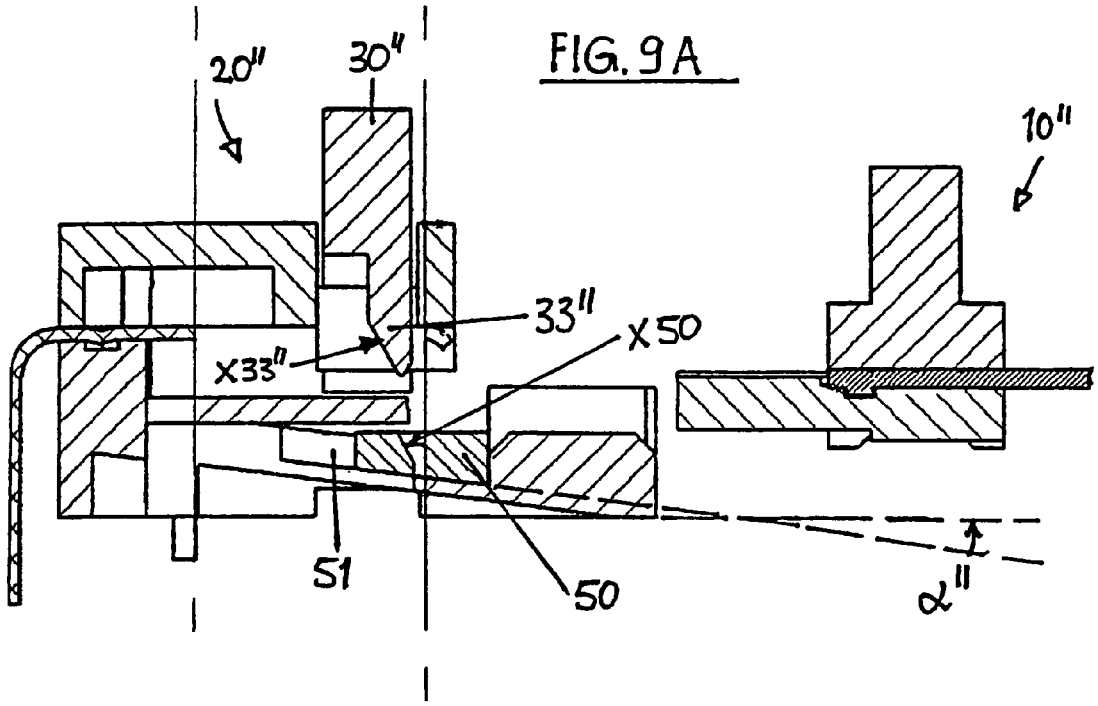
FIG. 9A is a cross-sectional view of a second variant of the plug and socket, before insertion of the plug, with a wedge element in place for generating the vertical motion upon forward thrust of the ribbon cable from the prelocking position into the final locking position.
Figure 9B:
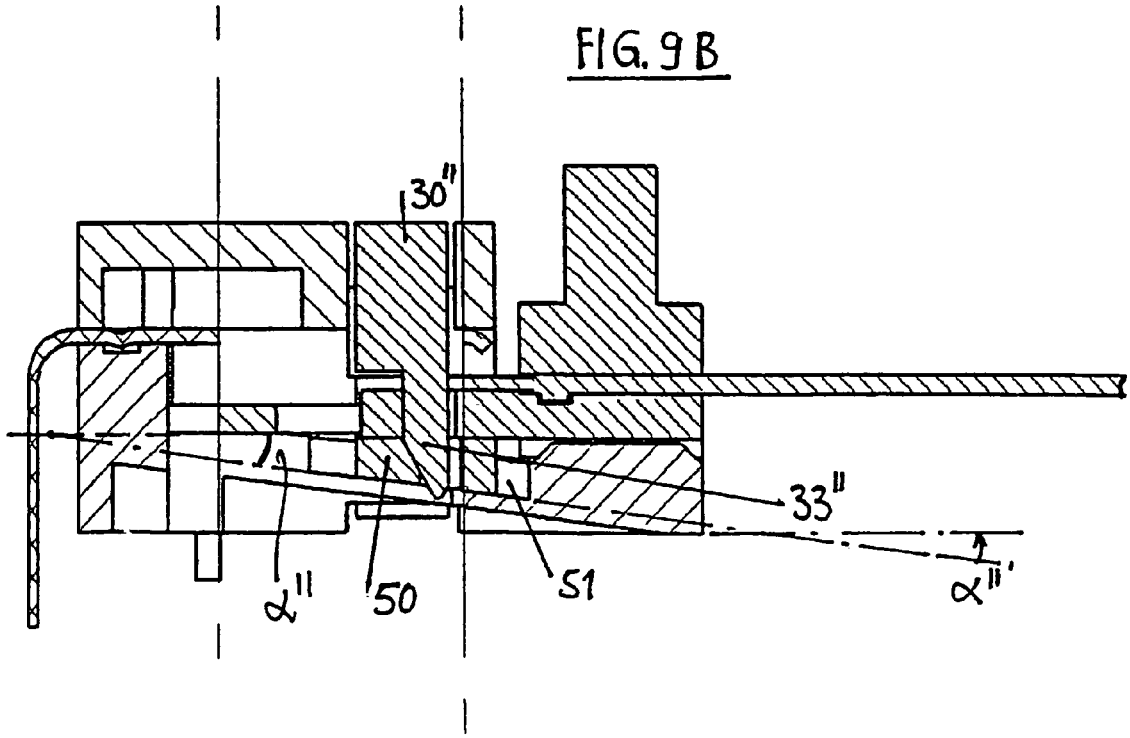
FIG. 9B is a cross-sectional view of a second variant of FIG. 9A, in the final locking position.
Figure 9C:
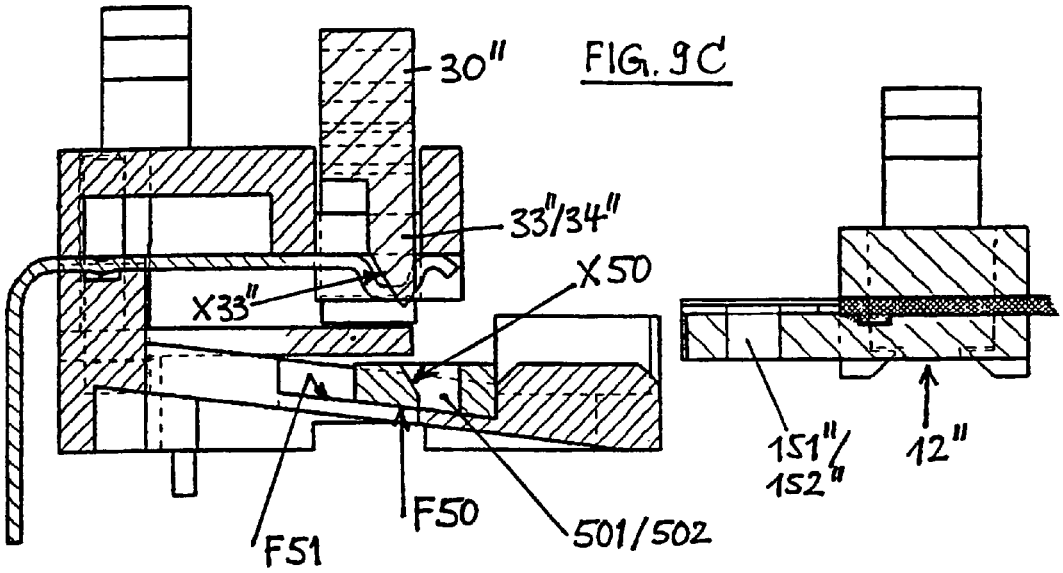
FIGS. 9C and 9D are second cross-sectional views of the second variant with the plug and socket in the same states as in FIGS. 9A and 9B, respectively.
Figure 9D:
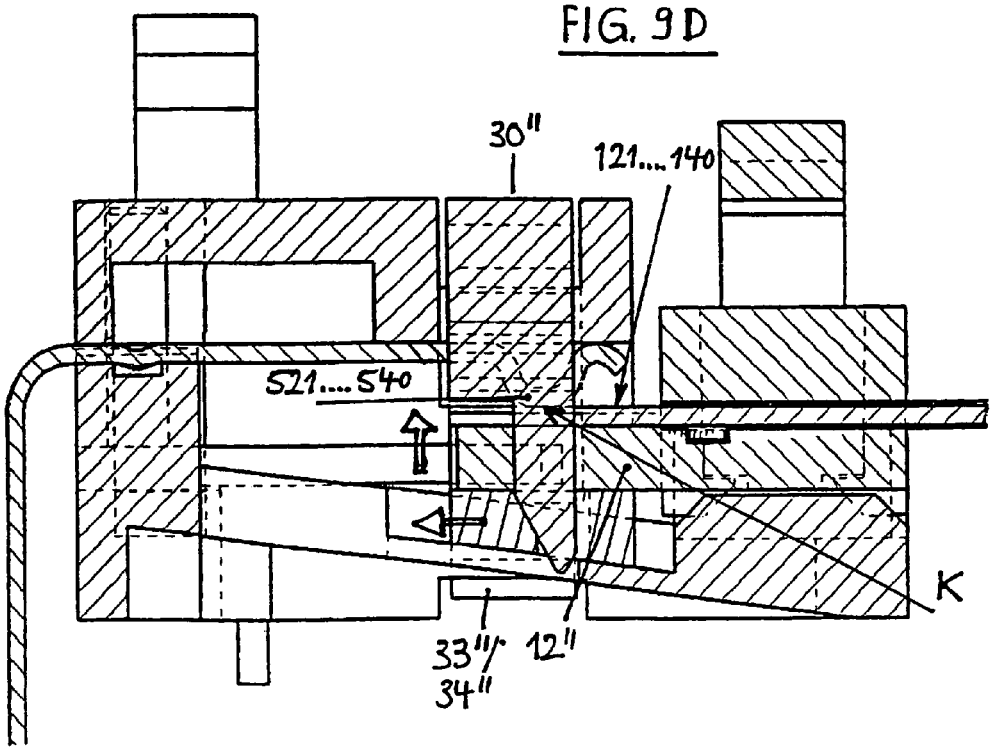
Figure 10A:
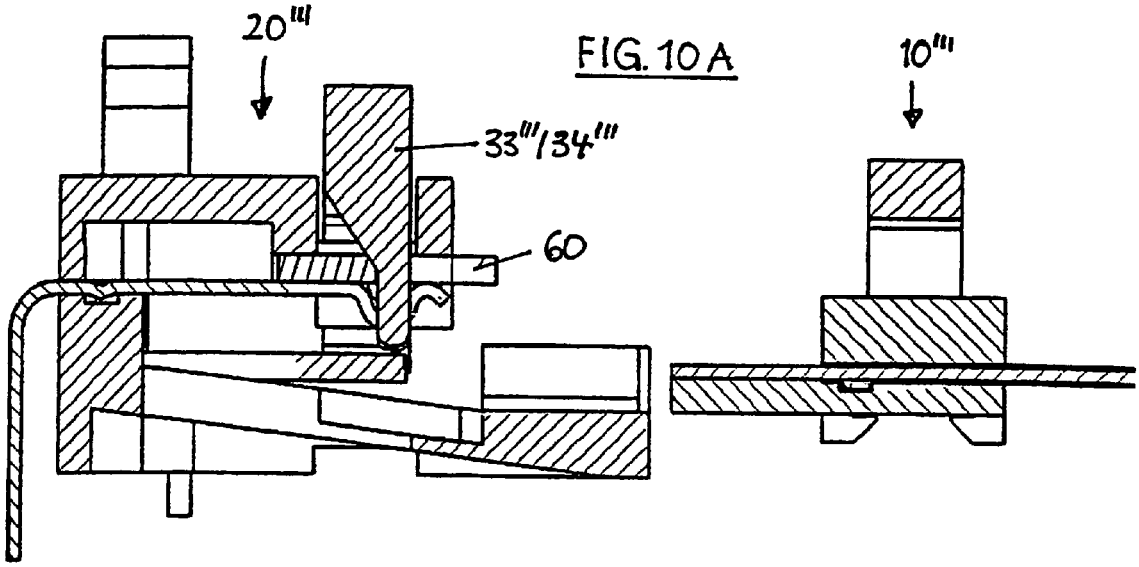
FIGS. 10A–10F are views of a third variant corresponding to FIGS. 9A–9F, respectively.
Figure 10B:
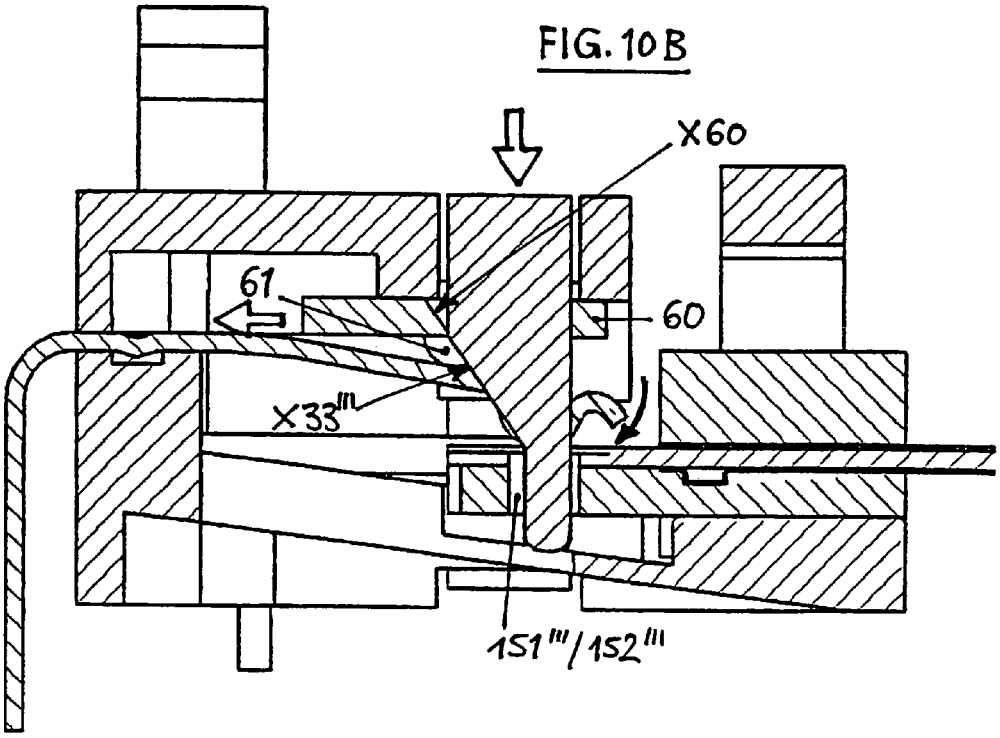
Figure 10C:
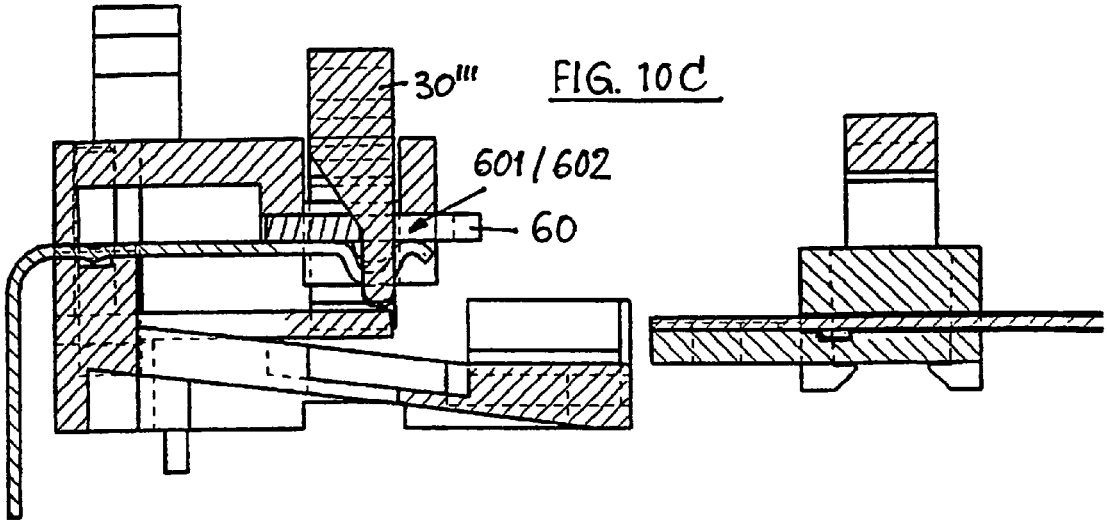
Figure 10D:
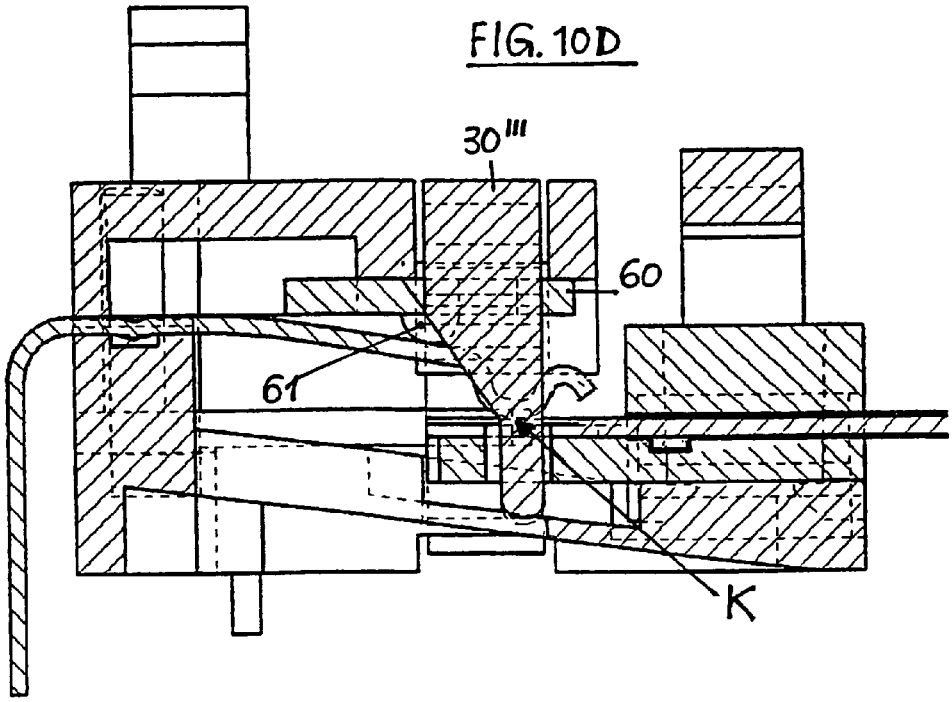
Figure 10E:
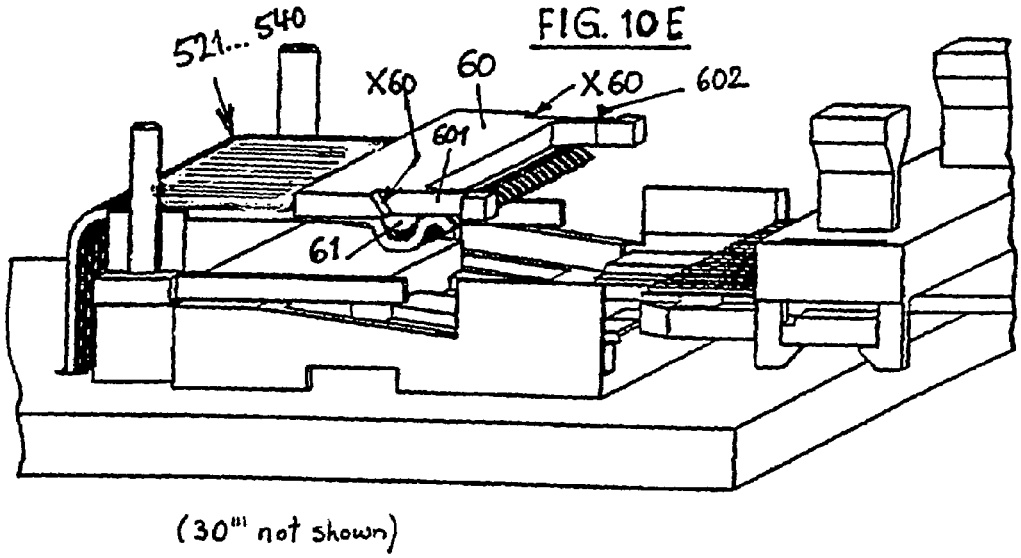
Figure 10F:
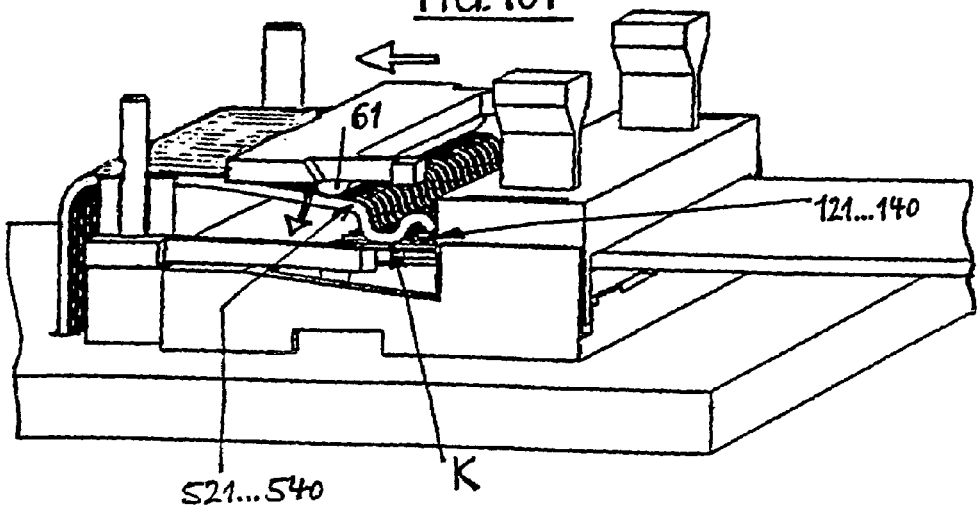

FIG. 8 shows a structural variant of the cooperation of the U-shaped bracket 30' with the recesses 151', 152' in the lower part 11' of the plug; with these recesses, the U-shaped bracket 30' is assigned not only the above-described function as a locking element but also that of an actuating element.

The fundamental concept of this embodiment is based on the conversion of the vertical motion (arrow V1) of the U-shaped bracket 30' by the lateral chamfers X33, X44 of the tongues 33' and 34' of the U-shaped bracket 30' into an axial displacement (arrow V2) of the plug 10 into the final locking position.

Other variants have as their subject first enabling a linear insertion of the plug into the socket and of providing additional means with which only after the prelocking position is reached is the requisite vertical relative motion effected between the respective conductor portions of the plug and socket, which motion then ends in the electrical making of contact in the final locking position.

A first variant is shown in FIG. 9: A separate wedge element 50 is used here, which is placed in a suitably chamfered well-like recess 51 in the lower part 22" of the socket 20" and which cooperates with the U-shaped bracket 30", as a "mobile sliding ramp", instead of the slide-on faces F12/F22. To that end, the wedge element has openings 501, 502 with lateral chamfers X50, Y50, which in the prelocking position are aligned with the recesses 151", 152" in the lower part 12". In this variant as well, the vertical motion of the U-shaped bracket 30" is converted via the lateral chamfers X50, X33" into an axial displacement, but not directly onto the plug introduced into the prelocking position, but instead the wedge element 50; the sliding of this wedge element on the slide-on faces F50, F51, which are essential here, brings about an elevatorlike lifting of the resting lower part 12" of the plug 10", until the contact position K between the associated conductor portions 121 . . . 140 and 521 . . . 540 is reached, in which position the final detent locking (FIGS. 9B, 9D, 9F) can then be effected. In this variant, the slide-on angle $\alpha''$ accordingly takes the place of the angle $\alpha$ for the ramp inclination in the preferred exemplary embodiment described above. Also in this variant, Also in this variant, the U-shaped bracket 30 as an actuating element for the transition from the prelocking position to the final locking position.

A second variant is shown in FIG. 10: In this variant, the place of the wedge element 50 is taken by a flatly block-shaped slide element 60, which on its underside has a recess 61, which cooperates with the channel-like embodiment of the second conductor portions 521 . . . 540 in the socket 20'''. The slide element 60 has openings 601, 602, through which the U-shaped bracket 30''' can reach with the legs 33''', 34'''. Once again, complementary chamfers X33''' and X34''' in cooperation with chamfers X60 in the openings 601, 602 serve to convert the vertical motion of the U-shaped bracket 30''' into a reverse motion of the slide element 60, as a result of which its recesses 61 also slide rearward on the second conductor portions 521 . . . 540 and finally press these conductor portions downward, in the contact position K, onto the associated first conductor portions 121 . . . 140, where the final detent locking then takes place. Consequently, in contrast to the exemplary embodiments described above, this variant dispenses with a vertical motion of the plug in the socket for achieving the contact position.

In the variants shown in FIGS. 8 and 9, the blocking of the recesses in the plug by the blocking tongues that is specified in the preferred exemplary embodiment for the engagement of the U-shaped bracket in the prelocking position is undone, since here, the engagement of the U-shaped bracket is the prerequisite for converting the vertical displacement of the U-shaped bracket into the axial motion of the plug (FIG. 8) or the wedge element (FIG. 9).

The invention claimed is:

1. A plug connector for a ribbon cable with multiple conductors having a contact portion composed of first conductor portions, said connector having a plug, which at least partly surrounds the ribbon cable and leaves the contact portion free, and having a socket with contact points, into which the plug can be introduced as far as a predetermined contact position, in which the contact points of the socket and the contact portion are in electrically conductive communication, characterized in that the plug (10) braces the contact portion (42) of the ribbon cable (40) on one side and clamps the ribbon cable in place in an axially fixed manner; that a retaining element is provided between said socket (20) and said plug (10), with which the plug (10) is pre-lockable in the socket (20) in a manner to transfer axial tension exerted on the cable (40) to the socket (20) via said retaining element once said plug has reached a defined axial detent position (R) in the socket (20); and that once this axial detent position (R) is exceeded, the contact portion (42) or the contact points, with a vertical component of motion, reach said predetermined contact position (K), in which the plug (10) is lockable in a final state to the socket (20) by means of a locking element.

2. The plug connector of claim 1, characterized in that the contact portion (42) is formed by first conductor portions (421 . . . 440), which are insulated from the ribbon cable (40).

3. The plug connector of claim 1, characterized in that the ribbon cable (40) is formed of a flexible foil, printed with conductors, the end portions of which foil form the first conductor portions.

4. The plug connector of claim 1, characterized in that the plug (10) comprises an upper part (11) and a lower part (12) with a front portion (12A), which protrudes past the upper part (11) by the length of the contact portion (42); and that the ribbon cable (40), between the upper part (11) and lower part (12), is clamped in place in axially fixed fashion, such that the contact portion (42) rests on and is braced by the front portion (12A), the socket (20) includes a lower part (22), in which two conductor portions (521 . . . 540) are retained, which form the contact points for the first conductor portions (421 . . . 440) of the contact portion (42) of the ribbon cable (40), and for tension-relieved prelocking of the plug (10) in the socket (20), the retaining element is at least one retaining tongue (261, 262) in the lower part (22), which upon reaching the axial detent position engages a profile section (164, 165) of guide elements (160 . . . 163) in the lower part (12) of the plug (10).

5. The plug connector of claim 1, characterized in that the socket (20) includes a lower part (22), in which two conductor portions (521 . . . 540) are retained, which form the contact points for the first conductor portions (421 . . . 440) of the contact portion (42) of the ribbon cable (40).

6. The plug connector of claim 1, characterized in that the plug (10) comprises an upper part (11) and a lower part (12) with a front portion (12A), which protrudes past the upper part (11) by the length of the contact portion (42); and that the ribbon cable (40), between the upper part (11) and lower part (12), is clamped in place in axially fixed fashion, such that the contact portion (42) rests on and is braced by the front portion (12A).

7. The plug connector of claim 6, characterized in that the ribbon cable has an underside and, for axial fixation, a plastic support (43) is glued onto the underside of the ribbon cable (40) and cooperates as a stop with a transversely extending groove or face-end edge (125) of the lower part (12).

8. The plug connector of claim 6, characterized in that for axial fixation of the ribbon cable (40'), the ribbon cable has lateral recesses (401, 402), which cooperate with complementary nubs or pegs (101, 102) in the lower part of the plug.

9. The plug connector of claim 6, characterized in that the upper part (11) and lower part (12) are joined to one another by means of pairs (171, 172) of lateral detent hooks, and the ribbon cable (40) is clamped between them.

10. The plug connector of claim 6, characterized in that the contact portion (42) is formed by first conductor portions (421 . . . 440), which are insulated from the ribbon cable (40), and for axial positioning of the ribbon cable (40) in the plug (10), profile sections are provided on the underside of the upper part, which toward the face end of the jacket portion (41) of the ribbon cable (40) catch as a stop.

11. The plug connector of claim 1, characterized in that the plug (10) comprises an upper part (11) and a lower part (12) with a front portion (12A), which protrudes past the upper part (11) by the length of the contact portion (42); and that the ribbon cable (40), between the upper part (11) and lower part (12), is clamped in place in axially fixed fashion, such that the contact portion (42) rests on and is braced by the front portion (12A), the upper part (11) and lower part (12) are joined to one another by means of pairs (171, 172) of lateral detent hooks, and the ribbon cable (40) is clamped between them, and the socket (20) includes an upper part (21), which fixes the second conductor portions (521 . . . 540) in the lower part (22).

12. The plug connector of claim 11, characterized in that the socket (20) includes a lower part (22), in which two conductor portions (521 . . . 540) are retained, which form the contact points for the first conductor portions (421 . . . 440) of the contact portion (42) of the ribbon cable (40), and the locking element is a U-shaped bracket (30), guided in the upper part (21), that has detent elements, pointing in the direction of the lower part (22), which serve to connect the lower part (22) to the upper part (21) and for the sake of the final detent locking engage the plug (10).

13. The plug connector of claim 12, characterized in that for connecting the U-shaped bracket (30) and the lower part (22), two first, outer detent tongues (31, 32) are provided, which engage lateral recesses (231, 232) in the lower part (22).

14. The plug connector of claim 12, characterized in that two second, inner detent tongues (33, 34) are provided, which for the final detent locking engage two recesses (151, 152) in the lower part (12) of the plug (10).

15. The plug connector of claim 14, characterized in that blocking elements are provided, which enable the final detent locking by the U-shaped bracket (30) only whenever they have been pressed laterally away from the plug (10) when it reaches the contact position (K).

16. The plug connector of claim 14, characterized in that the blocking elements are two blocking tongues (252, 252) in the lower part (22) of the socket (20).

17. The plug connector of claim 12, characterized in that the U-shaped bracket (30') has actuating means, which utilize the vertical motion of the U-shaped bracket for reaching the final locking position to provide an axial forward thrust of the plug (10) from the prelocking position into the final locking position.

18. The plug connector of claim 17, characterized in that two second, inner detent tongues (33, 34) are provided, which for the final detent locking engage two recesses (151, 152) in the lower part (12) of the plug (10), and the actuating means are lateral ramp faces (X33, X34) on the second detent tongues (33', 34'), which faces are disposed such that they enter into engagement with the recesses (151', 152') in the plug (10).

19. The plug connector of claim 12, characterized in that the actuating means are lateral ramp faces (X33", X34") on the second detent tongues (33", 34"), which cooperate with a separate wedge element (50) that is placed, in the lower part (11) of the plug (10), in a well-like receptacle (51).

20. The plug connector of claim 19, characterized in that the underside of the wedge element (50) and the receiving well (51) are inclined by a slide-on angle ($\alpha$") to the horizontal, such that a displacement of the wedge element (50) into the socket causes lifting of the plug into the contact position (K).

21. The plug connector of claim 12, characterized in that the actuating means are lateral ramp faces (X33'", X34'") on the second detent tongues (33'", 34'"), which cooperate with a slide element (60) above the second conductor portions (521 . . . 540) and press them downward onto the first conductor portions (121 . . . 140), without causing a vertical motion of the plug.

22. The plug connector of claim 21, characterized in that the slide element (60), on its underside, has recesses (61), which engage channels in the front region of the second conductor portion (521 . . . 540) and are forced out of them under the influence of the actuating means when the second conductor portions (521 . . . 540) are depressed.

23. The plug connector of claim 1, characterized in that the plug (10) has a lower part provided with a first bearing face (F12), the socket (20) has a lower part provided with a second bearing face (F22) facing said first bearing face, said bearing faces are inclined in complementary fashion by an acute angle ($\alpha$), such that a ramplike sliding-on motion is created, by which a virtually force-free introduction of the plug (10) into the socket (20) at least to the point of the axial detent position and prelocking occurs.

24. The plug connector of claim 23, characterized in that first guide channels (161A, 162A) on the bearing faces (F12, F22) are provided for guiding retaining tongues (261, 262) upon a transition of the plug connector from a prelocking position to a final detent locking position.

25. The plug connector of claim 24, characterized in that second guide channels (161, 162) on the bearing faces (F12, F22) are provided, into which, upon release from a final detent locking position to unlock the plug (10) and the socket (20), the retaining tongues (261, 262) are rerouted around the profile sections (164, 165) in the lower part (12) of the plug (10), in order to enable a relocking of the plug in its prelocking position (V) and complete removal of the plug from the socket (20).

* * * * *